US011834941B2

(12) United States Patent
Guidry

(10) Patent No.: US 11,834,941 B2
(45) Date of Patent: Dec. 5, 2023

(54) FRAC STACK WELL INTERVENTION

(71) Applicant: Cameron International Corporation, Houston, TX (US)

(72) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 98 days.

(21) Appl. No.: 17/215,373

(22) Filed: Mar. 29, 2021

(65) Prior Publication Data

US 2021/0355800 A1 Nov. 18, 2021

Related U.S. Application Data

(63) Continuation-in-part of application No. 16/440,344, filed on Jun. 13, 2019, now Pat. No. 10,961,802, and a continuation-in-part of application No. 16/440,408, filed on Jun. 13, 2019, now Pat. No. 10,961,801, which is a continuation-in-part of application No. 15/837,176, filed on Dec. 11, 2017, now Pat. No. 10,961,800, said application No. 16/440,344 is a continuation-in-part of application No. 15/837,176, filed on Dec. 11, 2017, now Pat. No. 10,961,800.

(60) Provisional application No. 62/694,883, filed on Jul. 6, 2018, provisional application No. 62/694,885, filed (Continued)

(51) Int. Cl.

| | |
|---|---|
| ***E21B 43/26*** | (2006.01) |
| ***E21B 33/072*** | (2006.01) |
| ***E21B 43/267*** | (2006.01) |
| ***E21B 33/06*** | (2006.01) |

(52) U.S. Cl.

CPC ..... *E21B 43/2607* (2020.05); *E21B 33/072* (2013.01); *E21B 33/062* (2013.01); *E21B 43/267* (2013.01)

(58) Field of Classification Search

CPC ..... E21B 43/26; E21B 33/072; E21B 43/267; E21B 33/062

See application file for complete search history.

(56) References Cited

U.S. PATENT DOCUMENTS

| | | | |
|---|---|---|---|
| 2,224,446 | A | 12/1940 | Penick et al. |
| 2,238,357 | A | 4/1941 | Allen |
| 2,427,073 | A | 9/1947 | Schweitzer |

(Continued)

FOREIGN PATENT DOCUMENTS

WO WO-2014058424 A1 * 4/2014 ..... E21B 33/068

OTHER PUBLICATIONS

Cameron General Catalog 1962-1963, Cameron Iron Works, Inc., Houston, Texas, cover and p. 1112 (2 pages).

*Primary Examiner* — Daphne M Barry
(74) *Attorney, Agent, or Firm* — Eubanks PLLC

(57) ABSTRACT

A fracturing system having rams for controlling flow through a fracturing tree is provided. In one embodiment, a well intervention method includes injecting fracturing fluid into a well through a bore of a frac stack coupled to a wellhead. The frac stack includes rams that can be moved between open and closed positions to control flow through the bore. The well intervention method also includes coupling a lubricator to the frac stack without a blowout preventer between the lubricator and the frac stack and lowering an intervention tool from the lubricator through the bore of the frac stack and into the well. Additional systems, devices, and methods for fracturing and intervention are also disclosed.

9 Claims, 27 Drawing Sheets

Related U.S. Application Data on Jul. 6, 2018, provisional application No. 62/433,923, filed on Dec. 14, 2016.

(56) References Cited

U.S. PATENT DOCUMENTS

| | | | | |
|---|---|---|---|---|
| 2,923,310 | A | 2/1960 | Eckert | |
| 3,102,709 | A | 9/1963 | Allen | |
| 3,159,378 | A | 12/1964 | Haag | |
| 3,333,816 | A | 8/1967 | Williams et al. | |
| 4,089,532 | A | 5/1978 | Kamyshnikov et al. | |
| 4,214,605 | A | 7/1980 | Hardgrave | |
| 4,541,608 | A | 9/1985 | Forester et al. | |
| 4,940,095 | A * | 7/1990 | Newman | E21B 19/22 166/387 |
| 5,005,802 | A | 4/1991 | McWhorter et al. | |
| 5,013,005 | A | 5/1991 | Nance | |
| 5,819,851 | A | 10/1998 | Dallas | |
| 6,164,619 | A | 12/2000 | Van Winkle et al. | |
| 6,244,336 | B1 | 6/2001 | Kachich | |
| 6,289,993 | B1 | 9/2001 | Dallas | |
| 6,296,225 | B1 | 10/2001 | Watts | |
| 6,719,262 | B2 | 4/2004 | Whitby et al. | |
| 7,207,382 | B2 | 4/2007 | Schaeper | |
| 8,573,557 | B2 | 11/2013 | Carbaugh et al. | |
| 9,115,562 | B2 | 8/2015 | Guidry et al. | |
| 9,249,643 | B2 | 2/2016 | Melancon | |
| 9,777,546 | B2 | 10/2017 | Hoover et al. | |
| 10,233,716 | B2 | 3/2019 | van Wijk et al. | |
| 10,961,800 | B2 | 3/2021 | Guidry | |
| 10,961,801 | B2 | 3/2021 | Christopherson et al. | |
| 10,961,802 | B2 | 3/2021 | Guidry | |
| 2006/0113501 | A1 | 6/2006 | Saacks et al. | |
| 2006/0254822 | A1 | 11/2006 | Ayling | |
| 2008/0173441 | A1* | 7/2008 | Bowles | E21B 19/08 166/70 |
| 2011/0030963 | A1 | 2/2011 | Demong et al. | |
| 2013/0153237 | A1 | 6/2013 | McGuire | |
| 2015/0136383 | A1* | 5/2015 | Guidry | E21B 34/02 166/85.1 |

* cited by examiner

FRAC STACK WELL INTERVENTION

CROSS-REFERENCE TO RELATED APPLICATIONS

This application is a continuation-in-part of U.S. patent application Ser. No. 16/440,344, filed on Jun. 13, 2019, which is a continuation-in-part of U.S. patent application Ser. No. 15/837,176, filed on Dec. 11, 2017, which claims benefit of U.S. Provisional Patent Application No. 62/433,923, filed Dec. 14, 2016, each of which is incorporated by reference herein in its entirety. This application is also a continuation-in-part of U.S. patent application Ser. No. 16/440,408, filed on Jun. 13, 2019, which claims benefit of U.S. Provisional Patent Application No. 62/694,883, filed on Jul. 6, 2018, and claims benefit of U.S. Provisional Patent Application No. 62/694,885, filed on Jul. 6, 2018, and is a continuation-in-part of U.S. patent application Ser. No. 15/837,176, filed on Dec. 11, 2017, which claims benefit of U.S. Provisional Patent Application No. 62/433,923, filed Dec. 14, 2016, each of which is incorporated by reference herein in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including sand and water—into the well to increase the well's pressure and form the man-made fractures. During fracturing operations, fracturing fluid may be routed via fracturing lines (e.g., pipes) to fracturing trees installed at wellheads. Conventional fracturing trees have valves that can be opened and closed to control flow of fluid through the fracturing trees into the wells.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to fracturing systems using rams to control fluid flow through a fracturing tree during fracturing operations. In some embodiments, the fracturing tree includes a frac stack body having ram cavities provided along a bore. Rams in the ram cavities can be opened and closed to control fracturing fluid and pressure in the fracturing tree. The fracturing tree and its components can include various features to reduce erosive wear of seals of the rams from fracturing fluid flowing through the tree. For example, in certain embodiments, a protective sleeve can be included to cover the ram cavities during fracturing. Additionally, rams of a frac stack can be used to seal around a tool line during well intervention in some embodiments.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
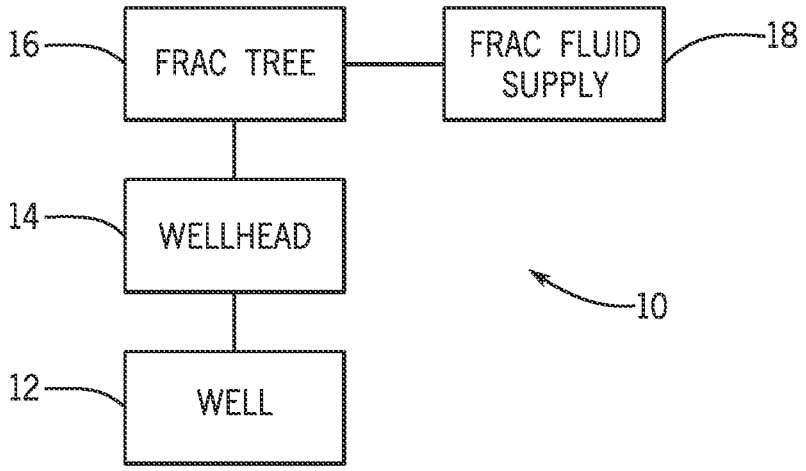
FIG. 1 generally depicts a fracturing system having a fracturing tree in accordance with an embodiment of the present disclosure.
Figure 2:
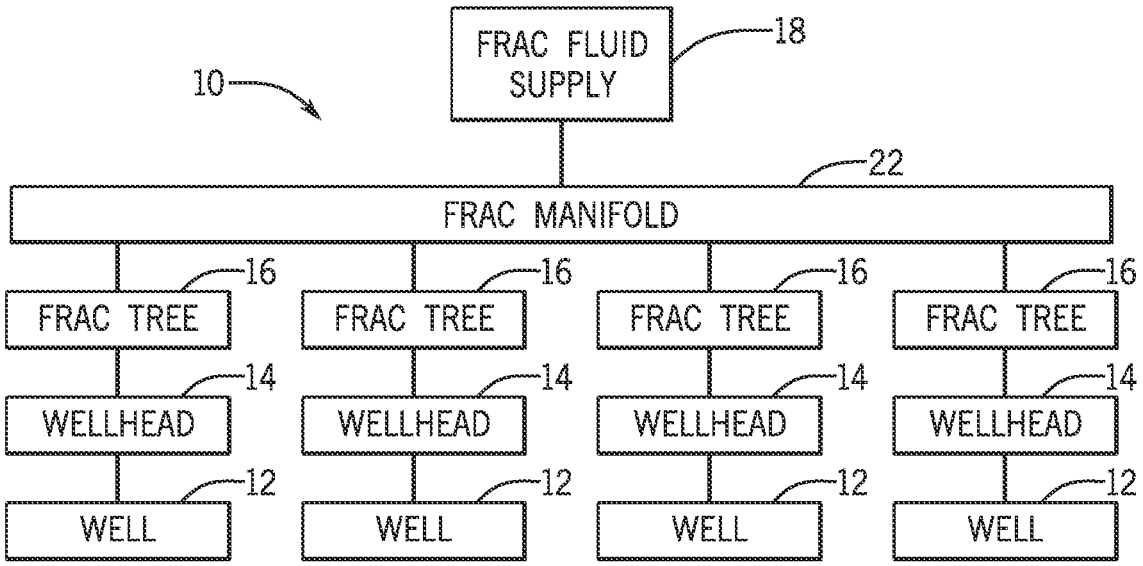
FIG. 2 is a block diagram of the fracturing system of FIG. 1 with a fracturing manifold coupled to multiple fracturing trees in accordance with one embodiment.

Turning now to the present figures, examples of a fracturing system 10 are provided in FIGS. 1 and 2 in accordance with certain embodiments. The fracturing system 10 facilitates extraction of natural resources, such as oil or natural gas, from a subterranean formation via one or more wells 12 and wellheads 14. Particularly, by injecting a fracturing fluid into a well 12, the fracturing system 10 increases the number or size of fractures in a rock formation or strata to enhance recovery of natural resources present in the formation. Wells 12 are surface wells in some embodiments, but it will be appreciated that resources may be extracted from other wells 12, such as platform or subsea wells.

The fracturing system 10 includes various components to control flow of a fracturing fluid into the well 12. For instance, the fracturing system 10 depicted in FIG. 1 includes a fracturing tree 16 that receives fracturing fluid from a fluid supply 18. In some embodiments, the fracturing fluid supply 18 is provided by trucks that pump the fluid to fracturing trees 16, but any suitable sources of fracturing fluid and manners for transmitting such fluid to the fracturing trees 16 may be used. Moreover, the fluid supply 18 may be connected to a fracturing tree 16 directly or via a fracturing manifold 22, as generally depicted in FIG. 2. The fracturing manifold 22 can include conduits, such as pipes, as well as valves or sealing rams to control flow of fracturing fluid to the fracturing trees 16 (or from the fracturing trees 16, such as during a flowback operation). As depicted in FIG. 2, the fracturing manifold 22 is connected to provide fracturing fluid to multiple fracturing trees 16, which may then be routed into respective wells 12 via wellheads 14. But it is noted that the fracturing manifold 22 may instead be coupled to a single fracturing tree 16.

Figure 3:
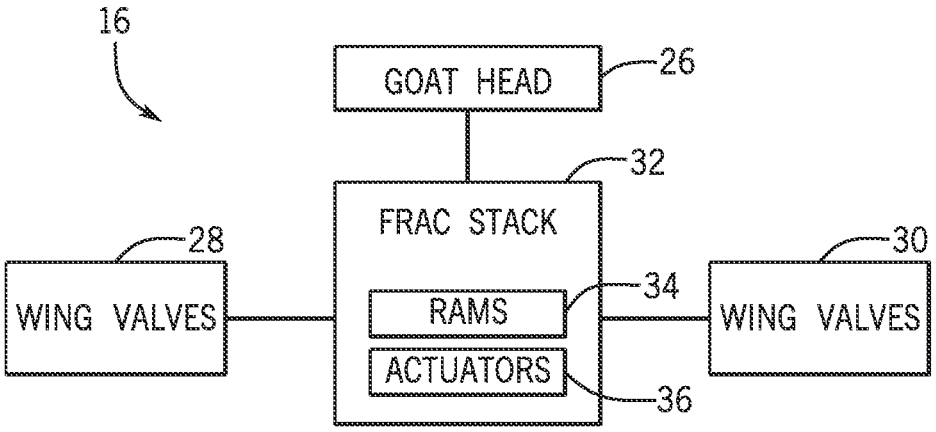
FIG. 3 is a block diagram showing components of the fracturing tree of FIG. 1, including a frac stack having rams for controlling flow through the fracturing tree, in accordance with one embodiment.

Fracturing trees have traditionally included valves (e.g., gate valves) that control flow of fracturing fluid to and from wells through the trees. In at least some embodiments of the present disclosure, however, the fracturing trees 16 use sealing rams instead of valves to control flow through the trees. One example of such a fracturing tree 16 is depicted in FIG. 3 as including a goat head 26, wing valves 28 and 30, and a fracturing stack ("frac stack") 32. The goat head 26 includes one or more connections for coupling the fracturing tree 16 in fluid communication with fluid supply 18, such as via fracturing manifold 22. This allows fracturing fluid from the fluid supply 18 to enter the fracturing tree 16 through the goat head 26 and then flow into the frac stack 32. When included, the wing valves 28 and 30 can take any of various forms. In one embodiment, for example, the wing valves 28 include pumpdown valves for controlling flow of a pumpdown fluid into the frac stack 32 and the wing valves 30 include valves for controlling flowback fluid exiting the well 12 through the wellhead 14 and the frac stack 32. In some other embodiments, either the wing valves 28 or the wing valves 30 could be omitted and the remaining wing valves (or even a single remaining wing valve) 28 or 30 could be used at different times for controlling flow of both pumpdown fluid and flowback fluid.

Figure 4:
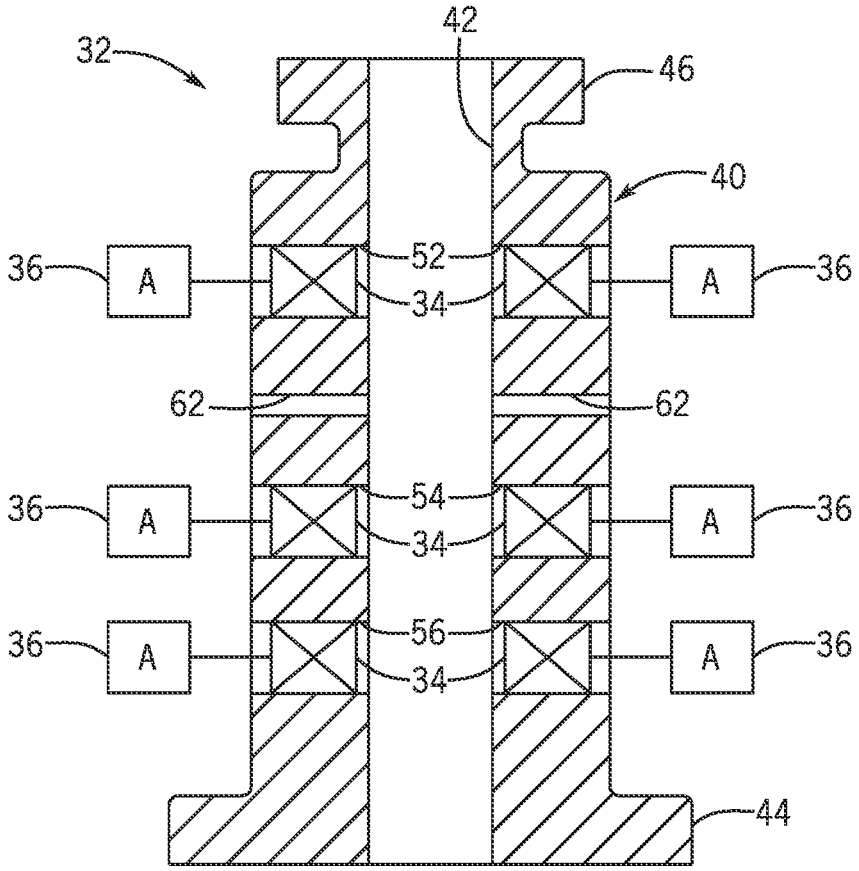
FIG. 4 is a schematic depicting the frac stack of FIG. 3 as having rams disposed in a body of the frac stack in accordance with one embodiment.

The frac stack 32 includes rams 34 that can be used to control flow of the fracturing fluid through the fracturing tree 16 (e.g., into a wellhead 14 and well 12). The frac stack 32 also includes actuators 36 for controlling opening and closing of the rams 34. One example of a frac stack 32 is depicted in FIG. 4 as having a hollow main body 40 with a bore 42 for conveying fluid through the body 40. The frac stack main body 40 also includes flanges 44 and 46 to facilitate connection of the body 40 to other components. For example, the main body 40 can be mounted on a wellhead 14 with the lower flange 44 and connected to the goat head 26 with the upper flange 46. The main body 40 can be fastened directly to the wellhead 14 and the goat head 26 in some embodiments, though in others the body 40 can be coupled to the wellhead 14 or the goat head 26 via an intermediate component, such as an adapter spool or a blowout preventer that is installed between the fracturing tree 16 and the wellhead 14.

In at least some embodiments, flow of fracturing fluid through the fracturing tree 16 and into the well 12 is controlled with rams 34 of the fracturing tree 16, and the fracturing tree 16 does not include a valve for controlling flow of fracturing fluid pumped through the fracturing tree 16 into the well 12. Further, in at least one such embodiment, the fracturing system 10 also does not include a valve between the fracturing tree 16 and the well 12 for controlling flow of fracturing fluid pumped into the well 12 through the fracturing tree 16.

The frac stack body 40 is depicted in FIG. 4 as having three pairs of opposing ram cavities—namely, ram cavities 52, 54, and 56—with installed rams 34 that are controlled by actuators 36. In other instances, however, the frac stack body 40 can have a different number of ram cavities. Rams are installed in the frac stack body 40 with keyed engagement in some embodiments to maintain desired orientation of the rams. For example, the rams may include keys that fit within slots along the ram cavities, or the ram cavities may include keys that fit within slots in the rams.

The frac stack main body 40 is also shown in FIG. 4 as including conduits 62 for routing fluid between the bore 42 and other components external to the body, such as the wing valves 28 and 30, which can be coupled to the body 40 in-line with the conduits 62. The body 40 can include valve flats or any other suitable features to facilitate attachment of the wing valves to the body. In some embodiments, a pumpdown fluid can be pumped into the bore 42 and then into a well 12 through one of the conduits 62 and flowback fluid from the well 12 can flow into the bore 42 and out of the frac stack body 40 through the other conduit 62. In another embodiment, pumpdown fluid can be pumped into the bore 42 and the flowback fluid can flow out of the bore 42 at different times through the same conduit 62. Flow through that conduit 62 may be controlled with one or more valves, such as a wing valve 28 or 30. In such cases, the body 40 may include just a single conduit 62, but other embodiments can include a different number of conduits 62. Further, conduits 62 can be provided at different axial positions along the body 40 in some instances. For example, one conduit 62 can be provided through the body 40 between ram cavities 52 and 54 (as depicted in FIG. 4), while another conduit 62 could be provided through the body 40 between the ram cavities 54 and 56. This would allow the rams in ram cavities 54 to selectively isolate the conduits 62 from one another to provide further control of flow through the body 40.

Figure 5:
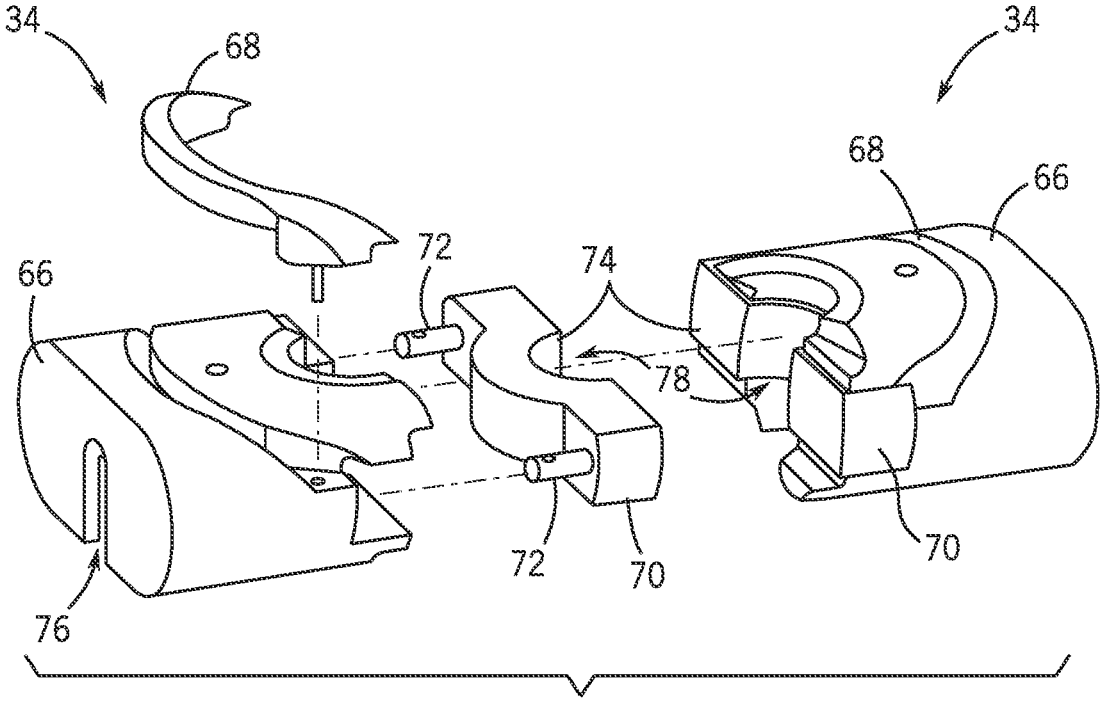
FIGS. 5 and 6 depict examples of rams that can be used in a fracturing tree, such as within the frac stack body of FIG. 4, in accordance with some embodiments.
Figure 6:
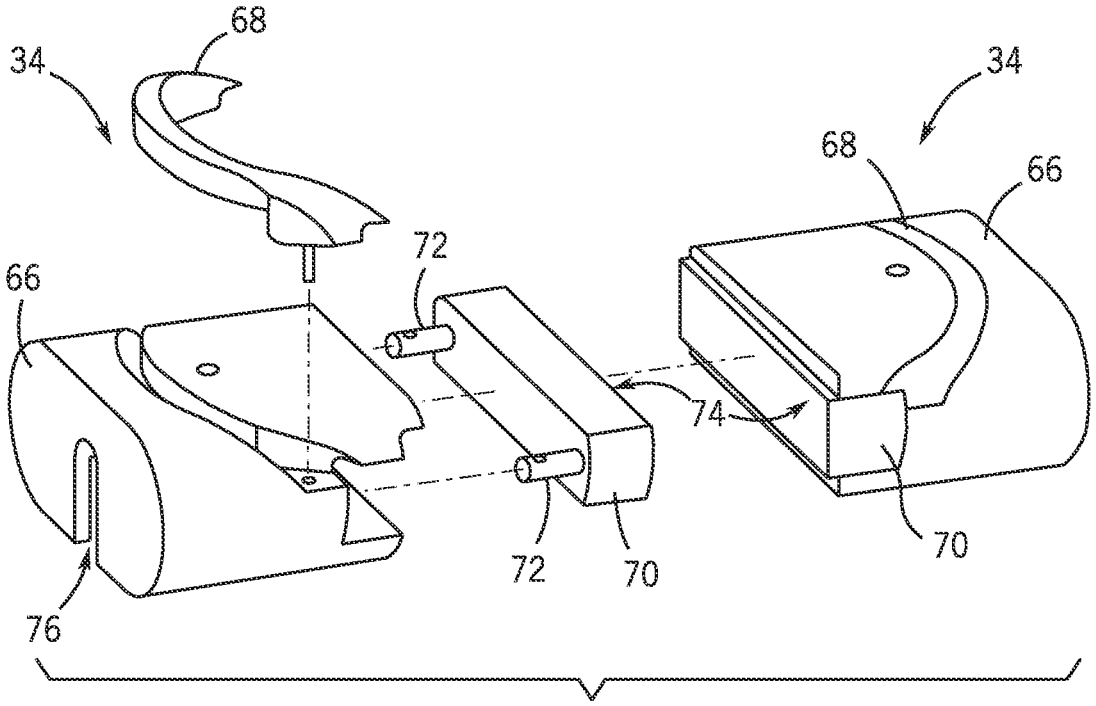

The frac stack 32 can include any suitable rams 34 and actuators 36. For example, the rams 34 can include blind rams, pipe rams, gate-style rams, or shear rams, and the actuators 36 could be electric, hydraulic, or electro-hydraulic actuators. Two examples of rams 34 that can be used in the frac stack body 40 are depicted in FIGS. 5 and 6. More particularly, the rams 34 are depicted as pipe rams in FIG. 5, with each ram 34 including a body or ram block 66, a ram seal 68 (here shown as a top seal), and a ram packer 70. The ram seal 68 and the ram packer 70 include elastomeric materials that facilitate sealing by the ram 34 in the frac stack main body 40. The ram packer 70 includes alignment pins 72 that are received in corresponding slots of the ram block 66 when the ram packer 70 is installed. The ram packers 70 include sealing surfaces 74 and recesses 78 that allow a pair of opposing pipe rams 34 to close about and seal against a tubular member, such as a pipe. The recesses 78 may be sized according to the diameter of the pipe about which the packers 70 are intended to seal. Additionally, in other embodiments, the rams 34 could be provided as variable-bore pipe rams used to seal around pipes within a range of diameters. Each ram 34 is also shown as including a slot 76 for receiving a portion (e.g., a button) of a connecting rod controlled by an actuator 36 for moving the ram 34 into and out of the bore 42 of the frac stack body 40.

Rams 34 in the frac stack body 40 may also or instead be provided as blind rams, such as those depicted in FIG. 6. In this example, the blind rams 34 include ram blocks 66, top seals 68, and ram packers 70. Unlike the packers 70 of the pipe rams in FIG. 5, however, the packers 70 in FIG. 6 do not include recesses 78 for receiving a pipe. Consequently, when installed in a frac stack body 40, the pair of blind rams 34 may close against one another along sealing surfaces 74 to seal the bore 42 and prevent flow through the frac stack 32. The ram packers 70 of FIG. 6 include alignment pins 72 similar or identical to those of FIG. 5. And like the pipe rams of FIG. 5, the blind rams shown in FIG. 6 include slots 76 for receiving connecting rods to enable control of the rams by actuators 36. Although the rams 34 depicted in FIGS. 5 and 6 are oval rams, in other instances the rams 34 could be round rams having a circular cross-section. Further, opposing rams 34 in the body 40 could instead be provided in other forms, such as gate-style rams that slide over one another or shear rams.

The actuators 36 can be hydraulic actuators with operating cylinders that are coupled to the frac stack body 40 and include operating pistons that control the position of the rams via connecting rods. In some other embodiments, the actuators 36 are electric actuators, which may include electric motors that control a drive stem for moving the rams. The actuators 36 can be attached to the frac stack body 40 in any suitable manner, such as with bonnets fastened to the frac stack body 40 with bolts, hydraulic tensioners, or clamps.

Figure 7:
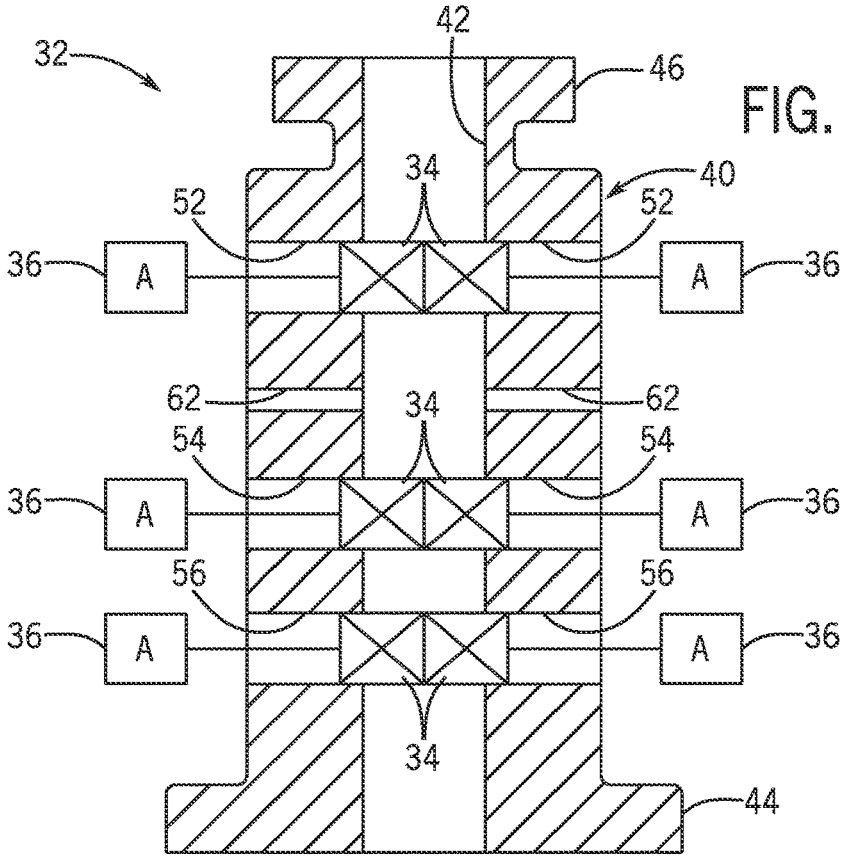
FIGS. 7 and 8 schematically depict closing of rams within the frac stack body of FIG. 4 in accordance with some embodiments.

As noted above, the rams 34 can be used to control flow through the frac stack body 40. As generally shown in FIG. 7, for example, each of the ram cavity pairs 52, 54, and 56 includes a pair of opposing rams 34 (e.g., blind rams) that are closed to seal against one another and prevent flow through the bore 42. The rams 34 in the cavities 52, 54, and 56 may be selectively retracted (i.e., opened) to allow fluid to flow through the bore 42. For instance, all of the rams 34 in FIG. 7 can be retracted to allow fracturing fluid to flow through the bore 42 from the upper end of the frac stack body 40 (such as from the goat head 26) to the lower end of the body 40, from which the fracturing fluid may flow into the wellhead 14 and then down into the well 12.

Figure 8:
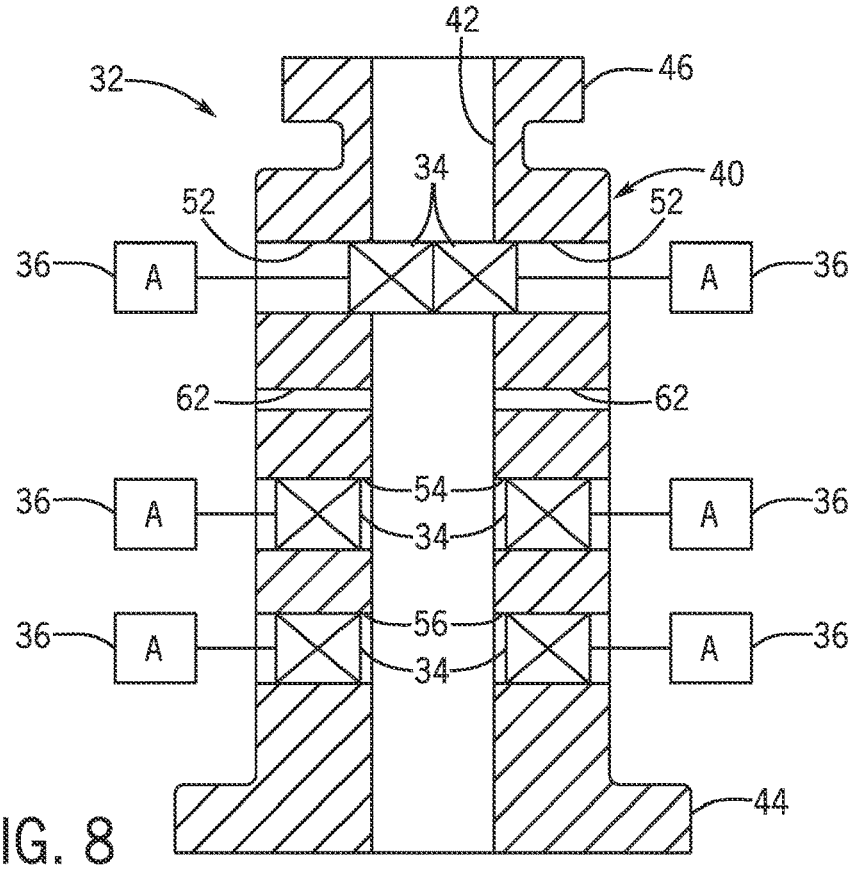

In other cases, some of the rams 34 in the frac stack body 40 are opened while other rams 34 in the body 40 remain closed. For example, the rams 34 in the ram cavities 52 may be closed while the rams 34 in the ram cavities 54 and 56 are open, as generally illustrated in FIG. 8. This allows fluid to pass between the conduits 62 and a lower portion of the bore 42, while the rams 34 of the ram cavities 52 isolate the lower portion of the bore 42 from an upper portion of the bore. In this arrangement, pumpdown fluid may be pumped through a conduit 62 into the bore 42 and then down into a well 12 while preventing flow of the pumpdown fluid out of the upper end of the frac stack 32. Similarly, flowback fluid coming up through the well 12 can be routed out of the frac stack body 40 through a conduit 62, with the closed rams 34 of the ram cavities 52 preventing flowback fluid from flowing out of the upper end of the frac stack 32.

Figure 9:
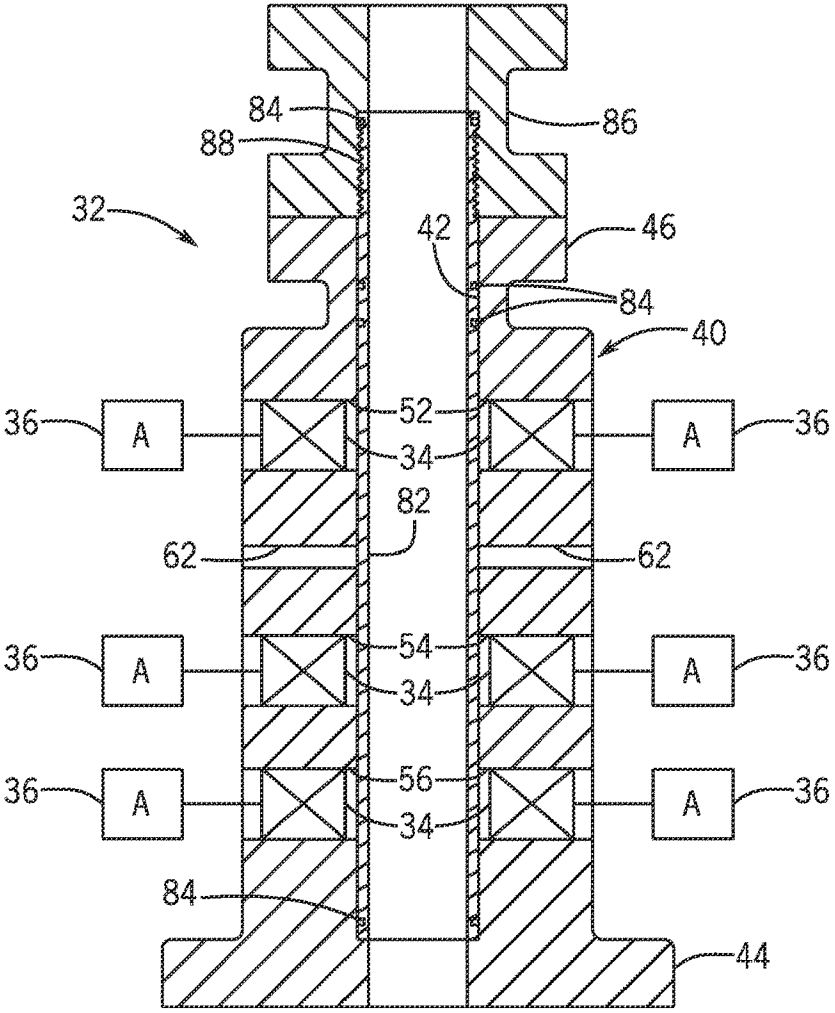

Fracturing fluid typically contains sand or other abrasive particulates that can erode components exposed to the fluid. In some embodiments, a protective sleeve is provided within the frac stack body 40 to isolate the rams 34 and their seals from erosive flow. One example of this is depicted in FIG. 9, which shows a protective sleeve 82 positioned in the bore 42 of the frac stack body 40. As shown, the protective sleeve 82 is landed on an internal shoulder within the frac stack body 40 and has an inner diameter equal to that of the bore 42 below the protective sleeve 82 at the internal shoulder. Seals 84 act as pressure barriers between the protective sleeve 82 and the wall of the bore 42 to prevent fracturing fluid from flowing along the outside of the sleeve 82 to the rams 34.

Figure 10:
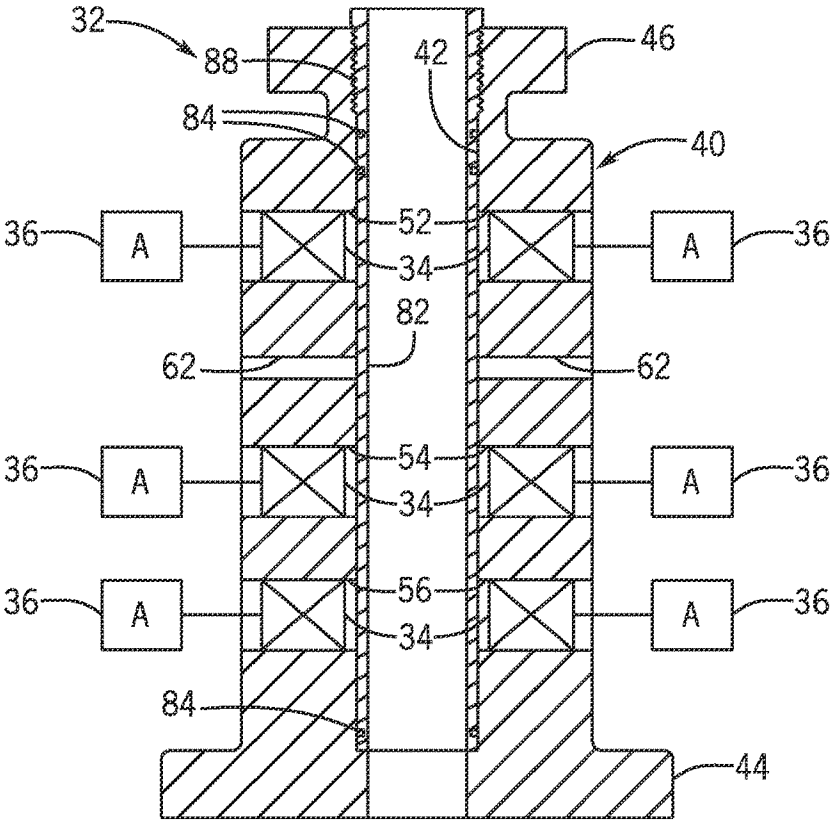
FIGS. 9 and 10 generally depict protective sleeves disposed in frac stack bodies to shield rams from erosive flow in accordance with some embodiments.

In some embodiments, the protective sleeve 82 is installed in the frac stack body 40 with an adapter component. In FIG. 9, for example, the protective sleeve 82 is connected via a threaded interface 88 to an adapter spool 86, which is fastened to the upper flange 46 of the frac stack body 40. But in other embodiments, the protective sleeve 82 is installed in the bore 42 without an adapter. One such embodiment is depicted in FIG. 10, in which the protective sleeve 82 is threaded instead to the upper end of the frac stack body 40. Although the top of the protective sleeve 82 is shown protruding from the frac stack body 40, the entire sleeve 82 could be received within the body 40 in other instances.

Figure 11:
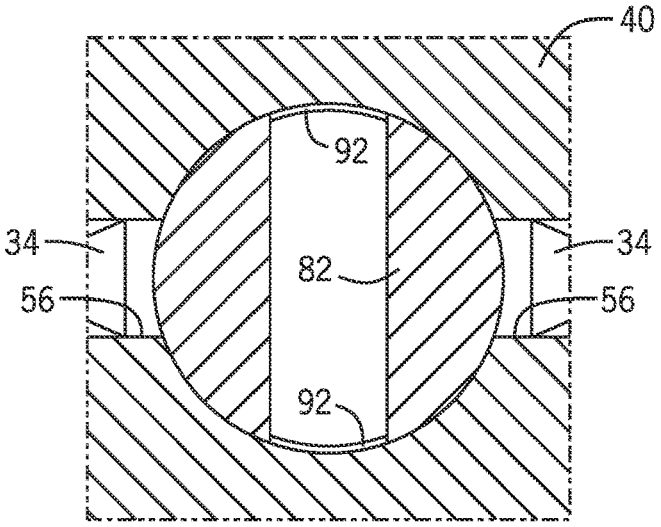
FIGS. 11-13 depict a protective sleeve that can be rotated to selectively shield rams in a frac stack body in accordance with one embodiment.
Figure 12:
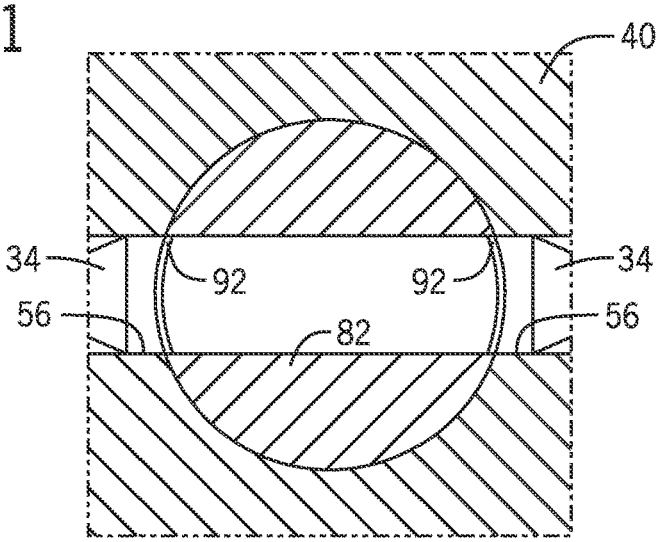
Figure 13:
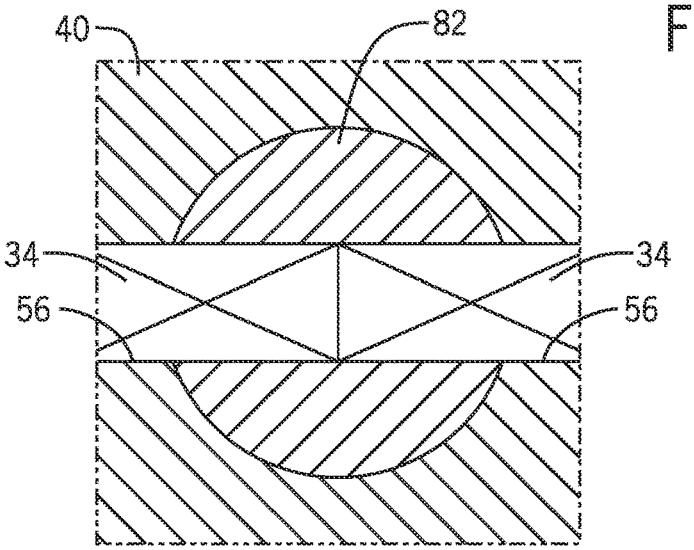

The protective sleeve 82 can be moved within the bore 42 of the frac stack body 40 to selectively cover ram cavities and protect installed rams 34. By way of example, a protective sleeve 82 with apertures 92 is depicted in FIGS. 11-13. With the sleeve 82 positioned as shown in FIG. 11, the apertures 92 are circumferentially offset from the ram cavities 56 and the side walls of the sleeve 82 shield rams 34 in the cavities 56 from erosive flow (e.g., of fracturing fluid) through the sleeve 82. Flow through the sleeve 82 (and, thus, the frac stack body 40) can be prevented by rotating the sleeve 82 to align the apertures 92 with the ram cavities 56 and then closing the rams 34 together through the apertures 92 to seal the bore, as generally shown in FIGS. 12 and 13. The rams 34 can later be opened and withdrawn out of the apertures 92 to allow flow, and the sleeve 82 can be rotated to again cover the ram cavities 56. In other embodiments, the protective sleeve 82 can be raised or lowered within the bore 42 to move the apertures 92 axially to selectively cover the ram cavities 56. Although ram cavities 56 are depicted in FIGS. 11-13, it will be appreciated that these same techniques and others described below could also or instead be used with other ram cavities, such as ram cavities 52 or 54.

Figure 16:
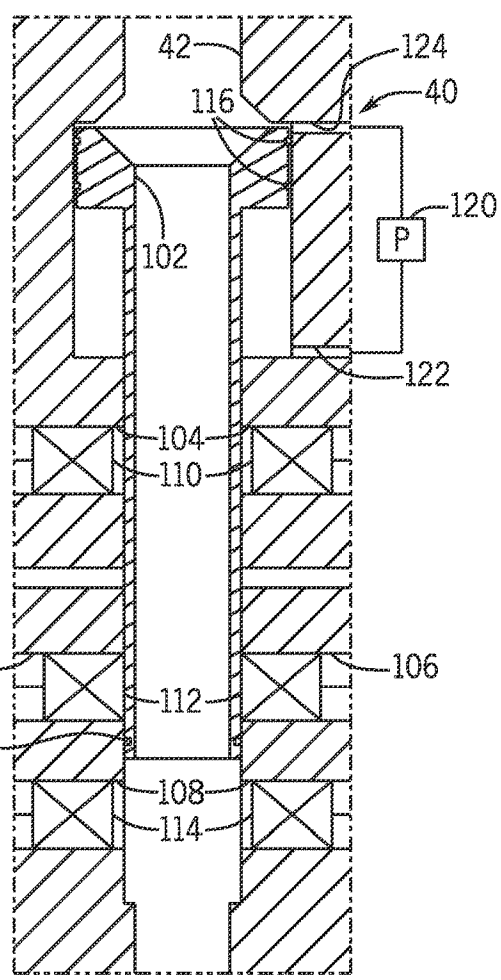
FIGS. 14-16 depict a protective sleeve that can be moved axially within a bore of a frac stack body to selectively uncover a pair of rams to facilitate flow control within the frac stack body in accordance with one embodiment.
Figure 15:
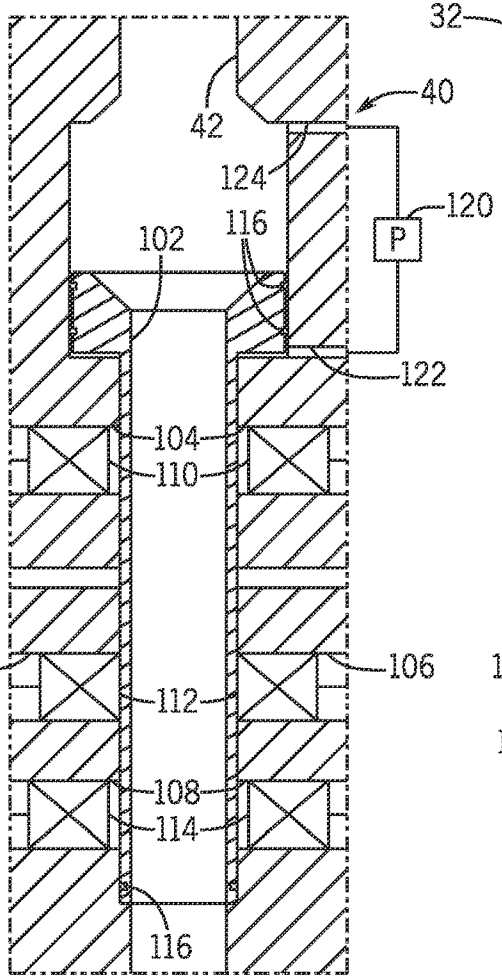
Figure 14:
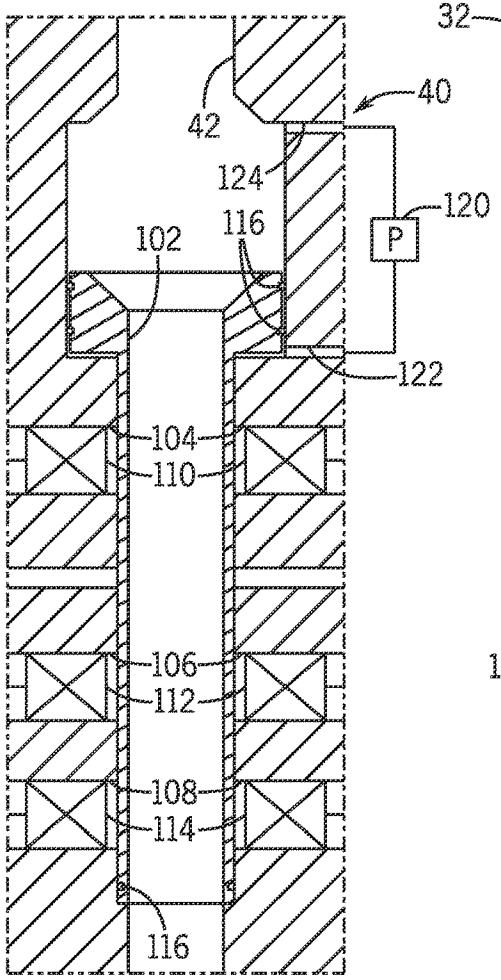

Another example of a frac stack 32 having a protective sleeve is generally depicted in FIGS. 14-16. In this embodiment, the protective sleeve 102 is disposed within the bore 42 to cover ram cavities 104, 106, and 108 and shield installed rams 110, 112, and 114 from erosive flow. The assembly includes seals 116 between the exterior of the sleeve 102 and the frac stack body 40. The seals 116 include lip seals in some embodiments, but the seals 116 (and the seals 84 above) can be provided in any suitable form. Because of the seals and the shape of the protective sleeve 102, pressurized fluid within the bore 42 applies a differential pressure on the sleeve 102 and biases the sleeve down into the position depicted in FIG. 14.

The protective sleeve 102 is shown in FIG. 14 as covering each of the ram cavities 104, 106, and 108. Although other rams may instead be used in the ram cavities, in at least some embodiments the rams 110 are shear rams, the rams 112 are pipe rams, and the rams 114 are blind rams. The protective sleeve 102 can be axially displaced to uncover the ram cavities 108 and allow the rams 114 to close and seal the bore 42.

In at least some embodiments, the protective sleeve 102 is hydraulically actuated. For example, as shown in FIGS.

14-16, the upper end of the protective sleeve 102 operates as a piston head to facilitate hydraulic actuation of the sleeve 102. More particularly, the sleeve 102 can be raised by routing fluid (such as with a pump 120) through conduit 122 into the bore 42 to lift the sleeve 102. In at least one embodiment, fluid within the bore 42 is used as the control fluid for actuating the protective sleeve 102. Fracturing fluid within the bore 42 can be diverted out from the bore 42 through conduit 124 and then be pumped with pump 120 or otherwise routed back into the bore through the conduit 122 to raise the protective sleeve 102, for instance. In at least some cases, the pipe rams 112 are closed to seal about the exterior of the sleeve 102 (as shown in FIG. 15) and fluid is then routed through the conduit 122 into the bore 42—more specifically, into an enclosed volume that is outside the sleeve 102 and partially bound by the pipe rams 112—to lift the sleeve 102 and expose ram cavities 108 (as shown in FIG. 16). The protective sleeve 102 can be lifted in different ways in other embodiments, such as with an electric motor or with an external hydraulic sleeve or cylinder. Once the sleeve 102 is lifted, the blind rams 114 may be closed to seal the bore 42 and prevent flow through the bore 42 of frac stack body 40. In an emergency, such as in the case of excessive flowback, shear rams 110 can be closed to shear the protective sleeve 102 and close the bore 42.

Figure 17:
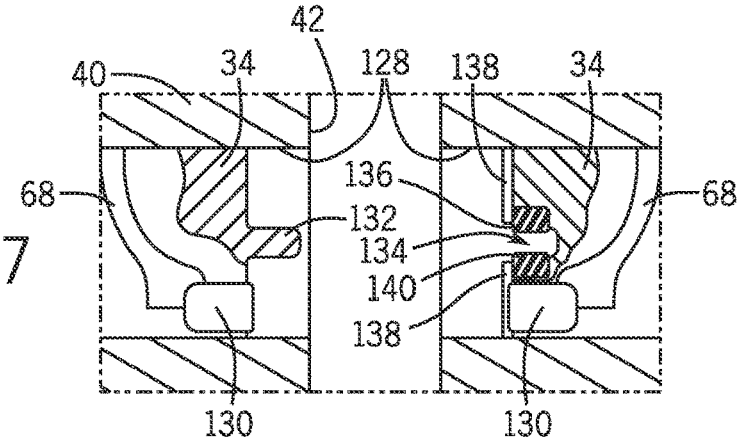
FIGS. 17-26 depict sealing configurations of rams that can be used in a fracturing tree in accordance with certain embodiments.
Figure 18:
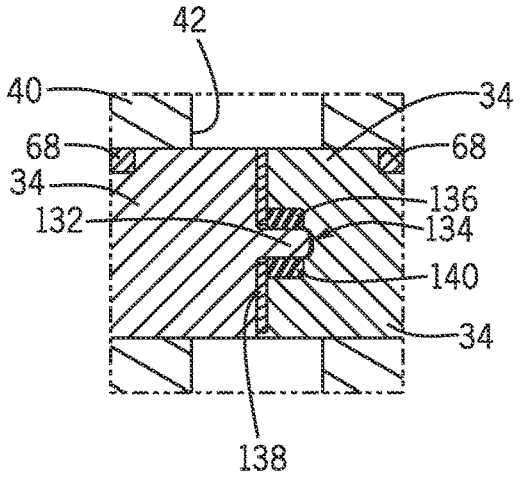

The rams of the frac stack 32 can be designed with features to reduce erosive wear on sealing elements and increase service life. One example is generally depicted in FIGS. 17 and 18, which show rams 34 disposed in opposing ram cavities 128 of a frac stack body 40. These rams 34 include top seals 68 and side packers 130 that seal against the frac stack body 40. But rather than having packers that extend across opposing front faces of the rams and seal against one another along those front faces when the rams are closed, the depicted rams 34 include a protruding ridge or nose 132 that is received in a slot 134 when the rams 34 are closed (FIG. 18).

Seals 136 and 140 (which may also be referred to as nose packers) within the slot 134 seal against the nose 132. When the rams 34 are closed, the seals 136 and 140 cooperate with the top seals 68 and the side packers 130 to prevent flow through the bore 42. Because the surfaces of the seals 136 and 140 that contact the nose 132 are positioned within the slot 134 transverse to the flow direction through the bore 42, erosive wear on these surfaces may be lower than in the case of front-facing packers (e.g., packers 70) exposed to abrasive flow generally parallel to their sealing faces. Although upper and lower nose packers 136 and 140 are depicted in FIGS. 17 and 18, either of these could be omitted and a single nose packer could be used in other embodiments. In at least some instances, plates 138 can be positioned along the front face of the ram 34 that has the nose packers 136 and 140 to retain or protect the packers 136 and 140. The plates 138 can be fastened to the ram block or attached in any other suitable manner.

Figure 19:
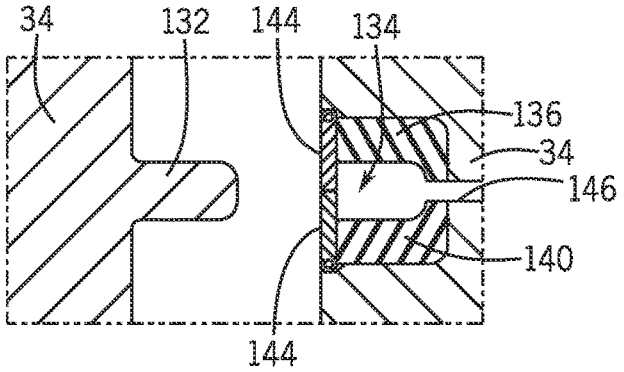
Figure 20:
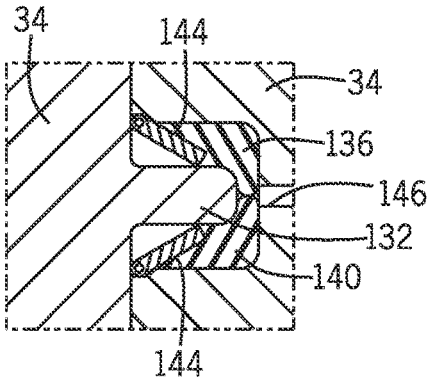

In another embodiment generally depicted in FIGS. 19 and 20, protective doors or blades 144 protect the nose packers 136 and 140. These blades 144 are displaced by the nose 132 during closing of the rams 34 against one another, with the nose packers 136 and 140 sealing against the nose 132 within the slot 134, as described above. As also shown in FIGS. 19 and 20, the ram 34 having the slot 134 can also include a weep hole 146 to allow fluid within the slot 134 to drain from the slot when displaced by the nose 132 during closing of the rams.

Figure 21:
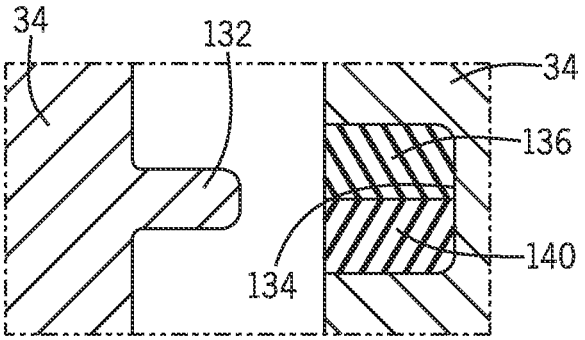
Figure 22:
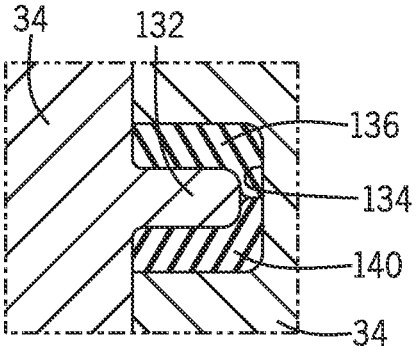

In FIGS. 17-20 above, the nose packers 136 and 140 are shown recessed from the front face of the ram. That is, the nose packers 136 and 140 in those figures are not provided at the leading edges of the rams 34. In other embodiments, the plates 138 and blades 144 are omitted and the nose packers 136 and 140 are positioned along the front face of the ram, such as depicted in FIGS. 21 and 22. In this example, the nose packers 136 and 140 press against one another when the rams 34 are open (FIG. 21), which may reduce abrasive wear on the surfaces of the nose packers 136 and 140 that seal against the nose 132 when the rams 34 are closed (FIG. 22).

Figure 23:
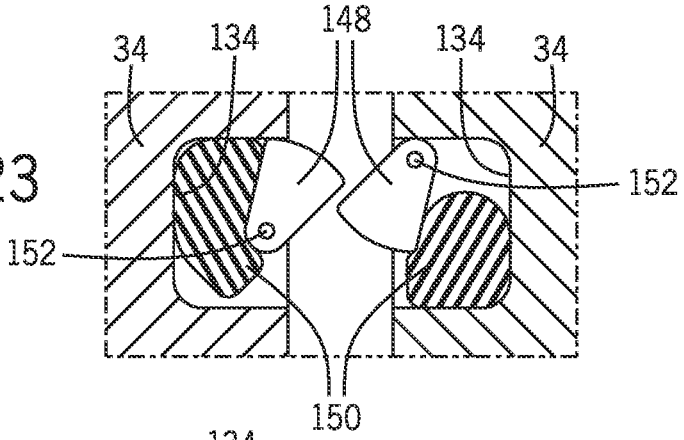
Figure 24:
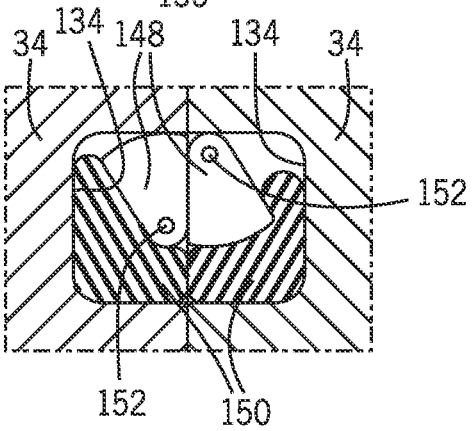

In yet another embodiment shown generally in FIGS. 23 and 24, the rams 34 include levers 148 (e.g., metal levers) that are positioned in front of seals 150 in slots 134 to protect those seals during fracturing. As depicted, the levers 148 contact each other and rotate about pins 152 when the rams close against one another. The rotating levers 148 push the seals 150 into sealing engagement with each other to close the bore and prevent flow.

Figure 25:
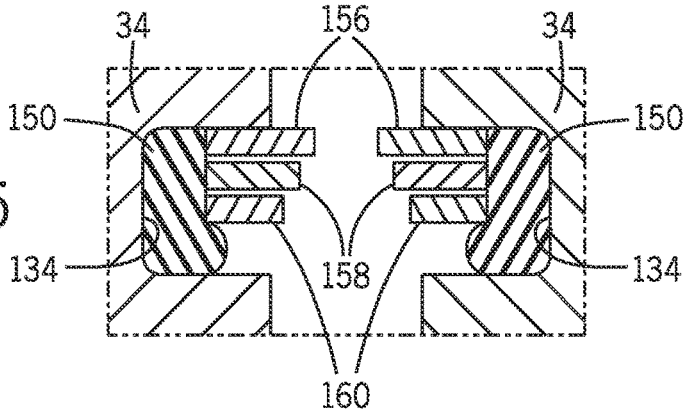
Figure 26:
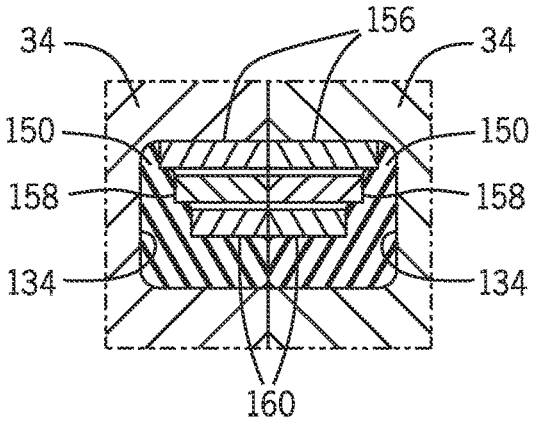

In a still further embodiment shown generally in FIGS. 25 and 26, the rams 34 include seals 150 in slots 134, along with metal plates 156, 158, and 160. These metal plates 156, 158, and 160 protect the seals 150 during fracturing and drive the seals 150 toward each other upon closing the rams 34. More specifically, as the rams 34 close, the metal plates 156 of the two rams engage one another and are pushed back into their respective slots 134 as the rams continue to close. This is followed by the metal plates 158 engaging one another and being pushed back into their slots 134, and then the metal plates 160 engaging one other and being pushed back into the slots 134, as the rams close. As the plates 156, 158, and 160 move back into the slots 134, they displace the seals 150 and drive the seals into sealing engagement with one another. While the plates 156, 158, and 160 are positioned in FIGS. 25 and 26 to generally drive the seals 150 below the plates, this could be reversed and the plates could drive the seals 150 above the plates (e.g., by flipping the rams 34). The metal plates 156, 158, and 160 can be connected within the ram 34 in any suitable manner. For example, the plates can be received in slots in the ram blocks or adhered to the seals 150. In certain embodiments, the plates 156, 158, and 160 are connected together, such as with mating pins and slots that allow the plates to slide relative to one another.

Figure 27:
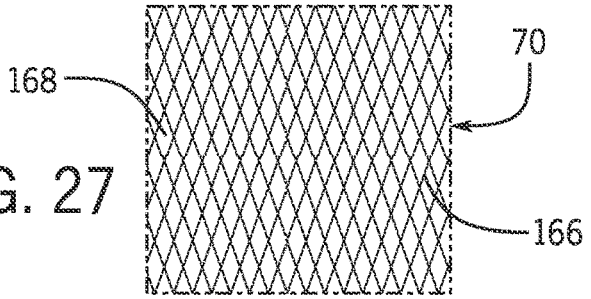
FIG. 27 depicts a portion of a ram packer or other seal having a wire mesh for reducing erosive wear of a body of the ram packer or other seal in accordance with one embodiment.

The packers and other seals described above can be formed of any suitable materials, and in at least some embodiments include elastomer. Some ram packers or seals can include a wire mesh to reduce erosive wear. For example, as depicted in FIG. 27, a ram packer 70 (or some other ram seal) includes a wire mesh 166 on an elastomer body 168. In some embodiments, the wire mesh 166 is partially embedded in the elastomer body 168, such as in a sealing face of the packer 70. The wire mesh 166 may reduce wear of the elastomer body 168 when placed in erosive service, such as within the frac stack body 40.

Figure 28:
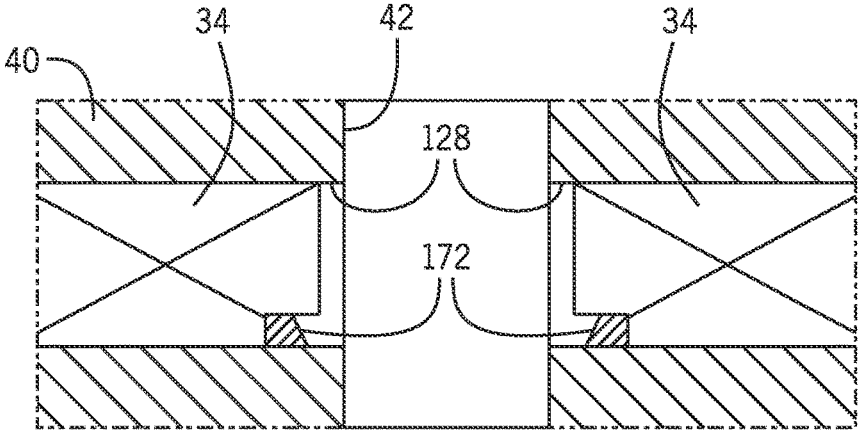
FIG. 28 depicts rams with wipers for pushing sand out of ram cavities and into a bore of a frac stack body in accordance with one embodiment.

Still further, in at least some embodiments the frac stack 32 includes features to reduce collection of sand or other particulates from the fracturing fluid within the frac stack body 40. By way of example, rams 34 in the frac stack body 40 can include blades or rubber wiper seals 172, as generally depicted in FIG. 28. As the rams 34 close, the blades or wiper seals 172 displace sand or other particulates that have settled on surfaces of the ram cavities 128. And in at least some embodiments, seals (e.g., lip seals) can be provided about the exterior of the rams 34 to seal against the surfaces of the ram cavities 128 and prevent fracturing fluid from flowing past the rams 34 from the bore 42 and depositing sand (or other particulates) behind the rams 34.

Figure 29:
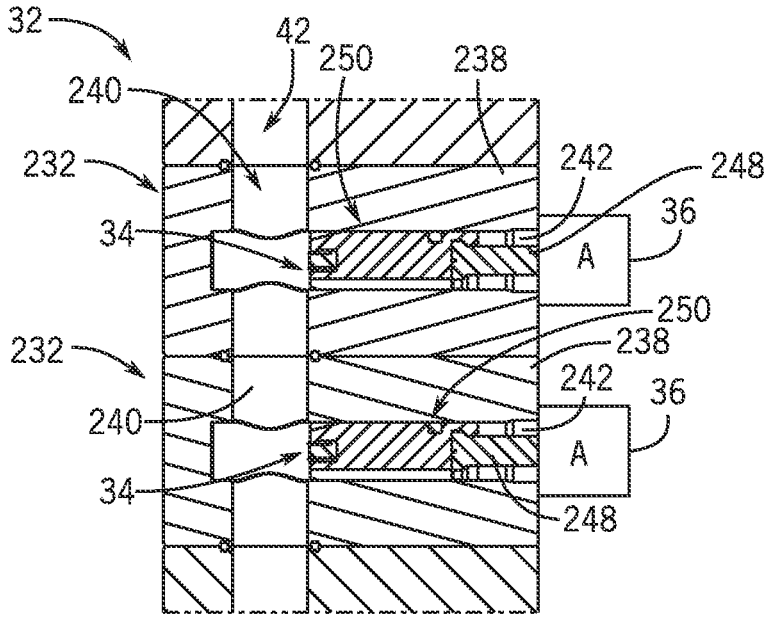
FIG. 29 depicts a frac stack having flow control devices with sealing rams in accordance with one embodiment.

Another example of a frac stack 32 having sealing rams 34 is shown in FIG. 29. In this depicted embodiment, the body of the frac stack 32 includes stacked flow control devices 232 with sealing rams 34 that can be opened and closed with actuators 36 (e.g., electric actuators, pneumatic actuators, hydraulic actuators, manual actuators, or a combination thereof). More specifically, the flow control devices 232 of FIG. 29 each include a single ram 34 that can be used to control flow of fracturing or other fluid through the frac stack 32. Although just a portion of the frac stack 32 is shown in FIG. 29, it will be appreciated that various additional components (e.g., goat head 26 and wing valves 28 and 30) can be used to control or otherwise facilitate flow through the frac stack 32, such as described above. The flow control devices 232 of the frac stack body can be connected to one another and to other equipment in any suitable manner. Further, while two flow control devices 232 are shown in FIG. 29, it will be appreciated that the frac stack 32 may include some other number of flow control devices 232, such as between three and six flow control devices 232 or just a single flow control device 232. The flow control devices 232 may be used for large bore (e.g., seven-inch) and high pressure (e.g., 15,000 psi) applications. In some embodiments, the flow control devices 232 are used in place of lower and upper master gate valves in a fracturing tree. The flow control device 232 could be used apart from the frac stack in other fracturing operations or could be used in other (i.e., non-fracturing) flow control contexts in other embodiments.

Figure 30:
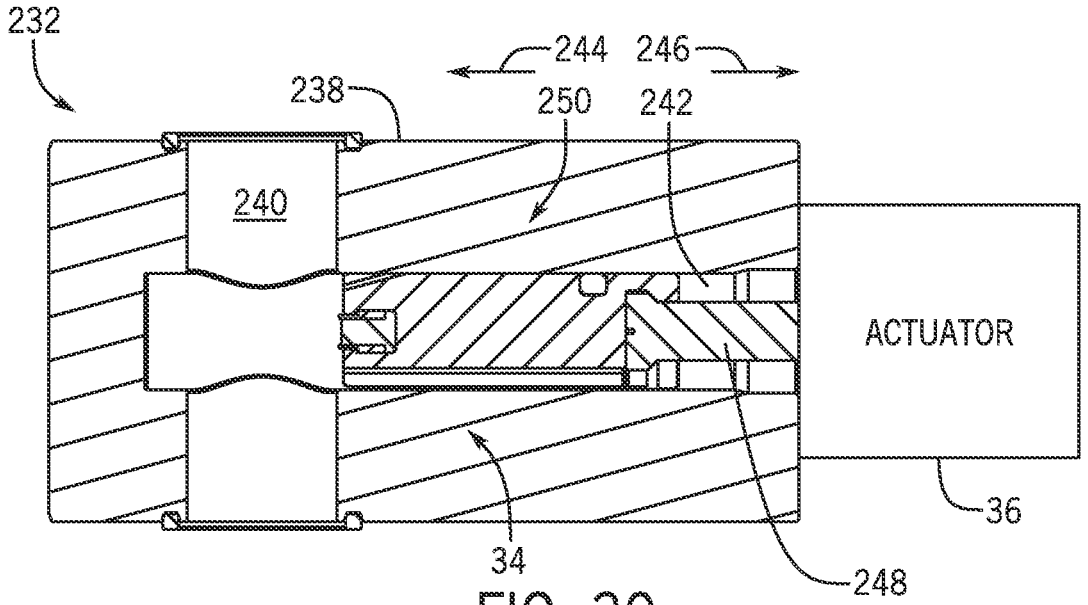
FIG. 30 is a cross-sectional view of one of the flow control devices of FIG. 29 in an open position in accordance with an embodiment of the present disclosure.

FIG. 30 is a cross-sectional view of one of the flow control devices 232 of FIG. 29 in an open position. The flow control device 232 includes a housing 238 with a bore 240 for conveying fluid through the housing 238. In operation, the flow of fracturing fluid through the bore 240 is controlled with the ram 34. As explained above, fracturing fluid includes proppant (e.g., sand) that props open cracks formed under pressure so that hydrocarbons can flow out of a formation. The ram 34 rests within a cavity 242 of the housing 238 and moves axially in axial directions 244 and 246 (FIG. 31) to open and close the bore 240. In an open position, the ram 34 is out of the bore 240 enabling fracturing fluid to flow through the housing 238 and into the well 12. By retracting the ram 34 out of the bore 240, the ram 34 is not exposed to the direct flow path through the housing 238, which may reduce erosion and wear on the ram 34.

The axial position of the ram 34 is controlled with the actuator 36. As explained above, the actuator 36 may be an electric actuator, pneumatic actuator, hydraulic actuator, manual actuator, or a combination thereof. The actuator 36 couples to the ram 34 with a shaft 248 that extends into the cavity 242. As will be explained below, the flow control device 232 includes a seal system 250 that enables ram 34 to form a seal with the housing 238, around the bore 240, without valve seats.

Figure 31:
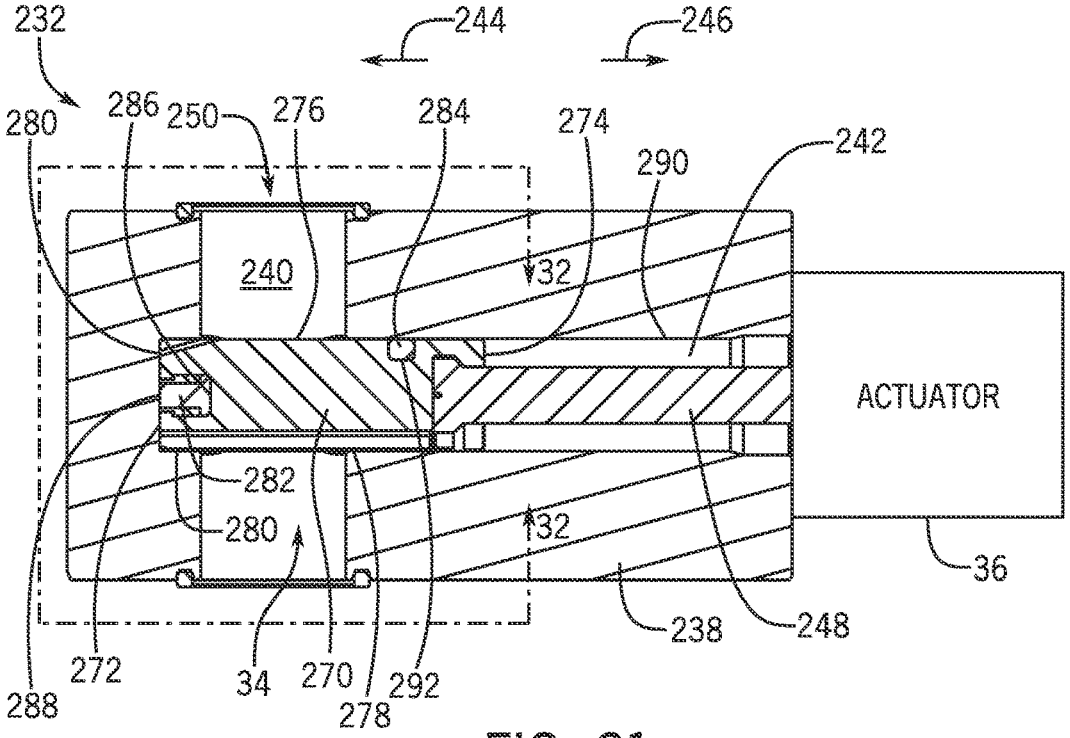
FIG. 31 is a cross-sectional view of the flow control device of FIG. 30 in a closed position in accordance with an embodiment of the present disclosure.

FIG. 31 is a cross-sectional view of the flow control device 232 in a closed position. The ram 34 includes a body 270 that supports the seal system 250. The body 270 includes a front face 272, a rear face 274, an upper surface 276, and a lower surface 278. In the closed position, the front face 272 rests within a recess 280 defined by the housing 238. The combination of the recess 280 and the cavity 242 enable the housing 238 to support the ram 34 under pressure within the bore 240. In order to form a seal within the housing 238, the ram 34 includes the seal system 250. The seal system 250 includes a front seal 282 and an upper seal 284. The front seal 282 is an elastomeric seal (e.g., nitrile, hydrogenated nitrile) that rests within a slot 286 of the front face 272 and is configured to form a seal with a surface 288 that defines the recess 280 (i.e., recess surface).

The upper seal 284 is also an elastomeric seal (e.g., nitrile, hydrogenated nitrile) and likewise forms a seal with the housing 238. As illustrated, the upper seal 284 engages and seals against a surface 290 (i.e., cavity surface) that defines the cavity 242. In order to retain the upper seal 284, the body 270 defines an upper seal groove 292 that receives the upper seal 284. By including elastomeric seals in the seal system 250, the flow control device 232 is able to form seals that block the flow of fracturing fluid through the bore 240 without using valve seats. More specifically, the elastomeric seals in the flow control device 232 may facilitate sealing in an erosive hydraulic fracturing environment because the elastomeric seals may be less susceptible to pitted surfaces. Accordingly, instead of forming a metal-to-metal seal between a ram and valve seats, the elastomeric seals of the flow control device 232 enable the ram 34 to seal with the housing 238.

Figure 32:
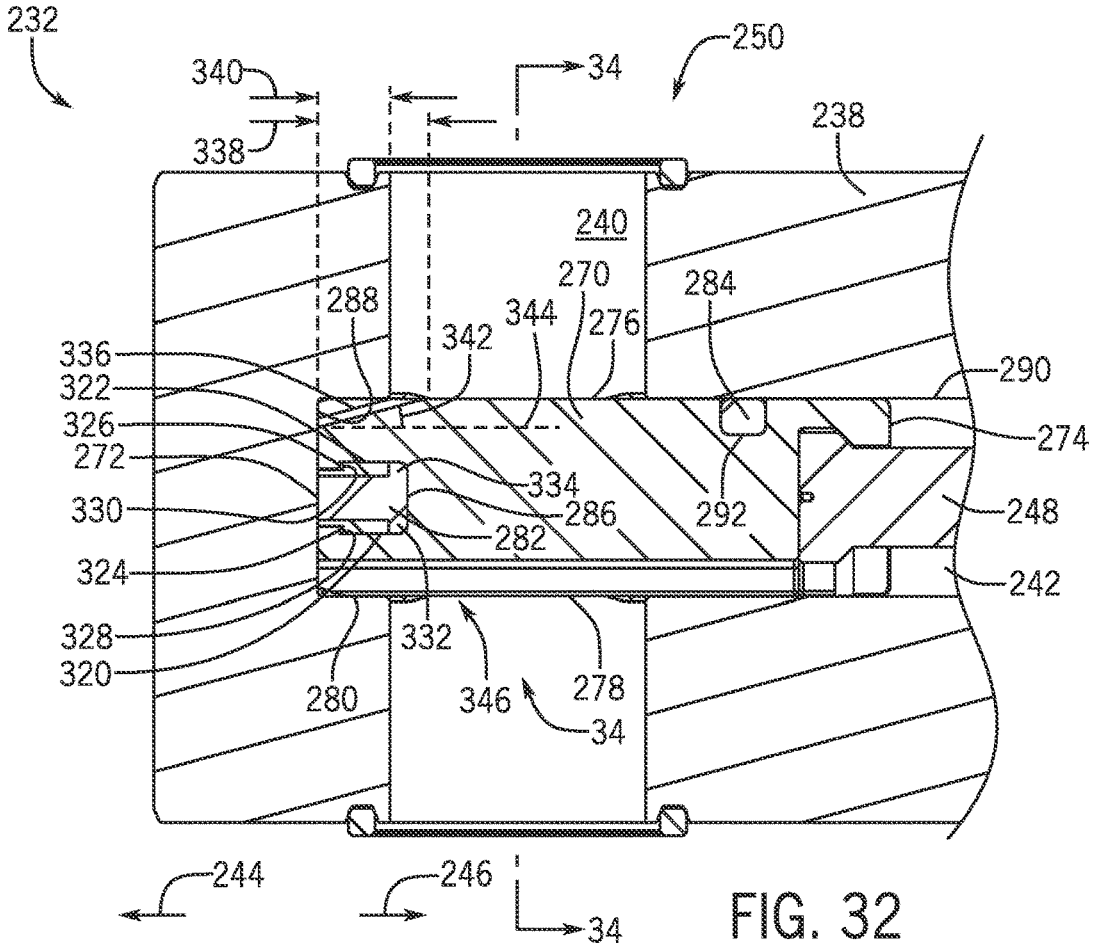
FIG. 32 is a detail view of the flow control device of FIGS. 30 and 31 in accordance with an embodiment of the present disclosure.

FIG. 32 is a detail view of the flow control device 232 of FIGS. 30 and 31. In some embodiments, the seal system 250 may include energizing plates 320 and 322. These energizing plates 320 and 322 may be made out of metal or another material that is more rigid than the elastomeric material of the front seal 282. The energizing plates 320 and 322 rest within the slot 286 and are placed on opposite sides of the front seal 282. The body 270 retains the energizing plates 320 and 322 with respective ledges/protrusions 324 and 326 that engage notches 328 and 330 on the respective energizing plates 320, 322. As illustrated above in FIG. 30, the energizing plates 320 and 322 are configured to extend beyond the front face 272. For example, the energizing plates 320 and 322 may extend between 1 mm and 20 mm beyond the front face 272. As the ram 34 moves in axial direction 244, the energizing plates 320 and 322 contact the surface 288, which blocks further axial movement of the plates 320 and 322 in axial direction 244. As the ram 34 continues to move in axial direction 244, the energizing plates 320 and 322 are driven in axial direction 246 (relative to the moving ram 34). As the energizing plates 320 and 322 move in axial direction 246, they engage ledges 332 and 334 on the elastomeric front seal 282. The force of the energizing plates 320 and 322 on the elastomeric front seal 282 flows through the elastomeric front seal 282 and drives the elastomeric front seal 282 in axial direction 244. In other words, the force of the energizing plates 320 and 322 energizes the elastomeric front seal 282 in axial direction 244 increasing the sealing force of the elastomeric front seal 282 against the housing 238. The energizing plates 320 and 322 may also limit or prevent extrusion of the elastomeric front seal 282 (e.g., into a gap between the front face 272 of the body 270 and the surface 288 of the recess 280) when closing the ram 34.

In some embodiments, the seal system 250 may not include energizing plates 320 and 322. Instead, a portion of the front seal 282 may extend beyond the front face 272, while the front seal 282 is retained within the slot 286 through contact between the ledges 332 and 334, and the ledges/protrusions 324 and 326.

Figure 33:
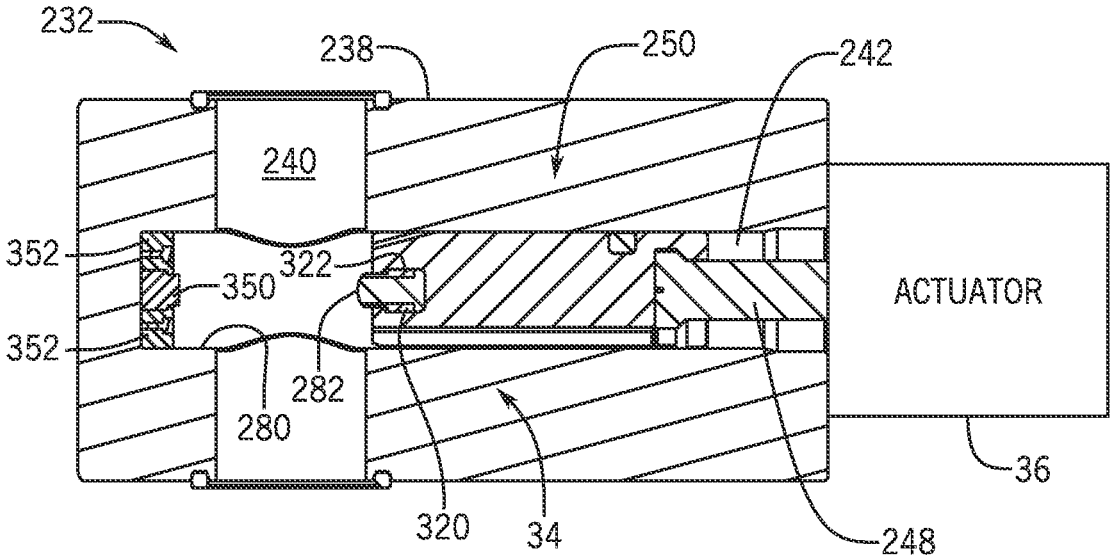
FIG. 33 is a cross-sectional view of a flow control device like that of FIG. 30 but in which the flow control device housing includes a seal for sealing against a closed ram of the flow control device in accordance with an embodiment of the present disclosure.

Further, in some instances the housing 238 of the flow control device 232 may include a seal in the recess 280 opposite the ram 34. One example of such a flow control device 232 is shown in FIG. 33. In this depicted embodiment, the housing 238 of the flow control device 232 includes a seal 350 (e.g., an elastomer seal) in the recess 280 across the bore 240 from the ram 34. This opposing seal 350 is positioned to seal against the front seal 282 when the ram 34 is moved to the closed position. The seal 350 can be retained in the recess 280 with mounting plates 352 or in any other suitable manner. In another embodiment, the seal 350 can include projecting arms (e.g., a U-shaped packer) extending along the sides of the bore 240 toward the cavity 242 to facilitate sealing along sides of a closed ram 34.

As explained above, the flow control device 232 controls the flow of fracturing fluid through the bore 240. Fracturing fluid contains proppant (e.g., sand) that props open cracks created by the pressurized fracturing fluid after the fracturing fluid is depressurized. The seal system 250 enables the flow control device 232 to form seals with the housing 238 without using valve seats. However, the flow of sand in the fracturing fluid may result in sand buildup. To facilitate the removal of sand or to prevent the buildup of sand within the flow control device 232, the ram 34 may include one or more grooves/slots in the body 270. For example, the body 270 may define a groove/slot 336 in the upper surface 276. This groove/slot 336 may facilitate evacuation of sand from the recess 280 and reduce interference from sand on movement of the ram 34 into and out of the recess 280. In some embodiments, the groove/slot 336 may have a length 338 that is greater than a depth/length 340 of the recess 280. In still other embodiments, the groove/slot 336 may also be angled. For example, the groove/slot 336 may form an angle 342 with a longitudinal axis 344 of the body 270. The angle 342 of the groove/slot 336 may enable sand to slide off the upper surface 276.

In addition to the groove/slot 336, the ram 34 may include another groove/slot 346 in the lower surface 278 of the body 270. The groove/slot 346 may extend from the front face 272 to the rear face 274. This groove/slot 346 may reduce sand accumulation in the recess 280 and interference from sand on movement of the ram 34 in axial direction 244 while closing the bore 240. Furthermore, the groove/slot 346 may facilitate opening of the bore 240 as the ram 34 moves in axial direction 246. More specifically, sand and fluid accumulation in the cavity 242 is able to flow out of the cavity 242 through the groove/slot 346 as the ram 34 moves in axial direction 246. In this way, the flow control device 232 may use little to no grease during operation while still controlling the flow of fracturing fluid into and out of the well 12. In other words, the flow control device 232 may not include grease in the cavity 242 to block proppant from entering the cavity 242.

Figure 34:
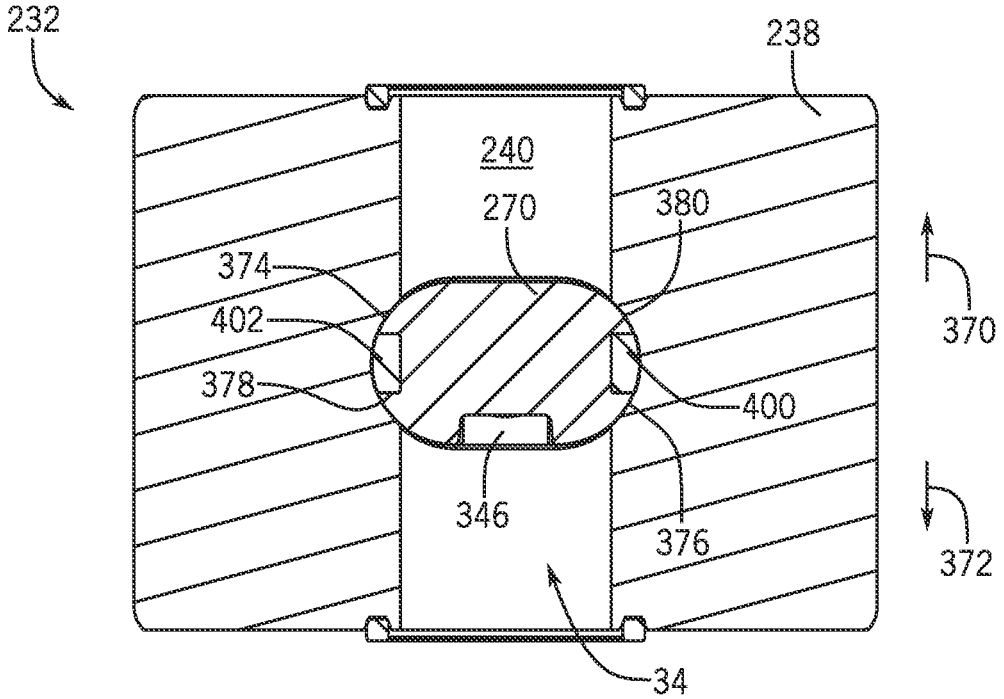
FIG. 34 is a cross-sectional view of the flow control device in FIG. 32 in accordance with an embodiment of the present disclosure.

FIG. 34 is a cross-sectional view of the flow control device 232 in FIG. 32 along lines 34-34. As illustrated, the body 270 of the ram 34 may have an oval shape. In operation, the housing 238 reduces deflection of the ram 34 in directions 370 and 372 by enabling the ram 34 to rest within the recess 280 in a closed position as well as by providing grooves that receive the sides of the ram 34. More specifically, the body 270 may include opposing side surfaces 374 and 376 that rest within respective sidewall grooves 378 and 380 of the housing 238, which block/reduce movement (e.g., deflection) of the ram 34 in directions 370 and 372. In addition, the oval shape of the body 270 may block rotation of the ram 34. It should be understood that the body 270 of the ram 34 may have a different shape (e.g., square, rectangular, circular, semi-circular). However, if the body 270 of the ram 34 has a circular shape the flow control device 232 may include an anti-rotation feature to orient the seal system 250 and the grooves/slots 336, 346.

Figure 35:
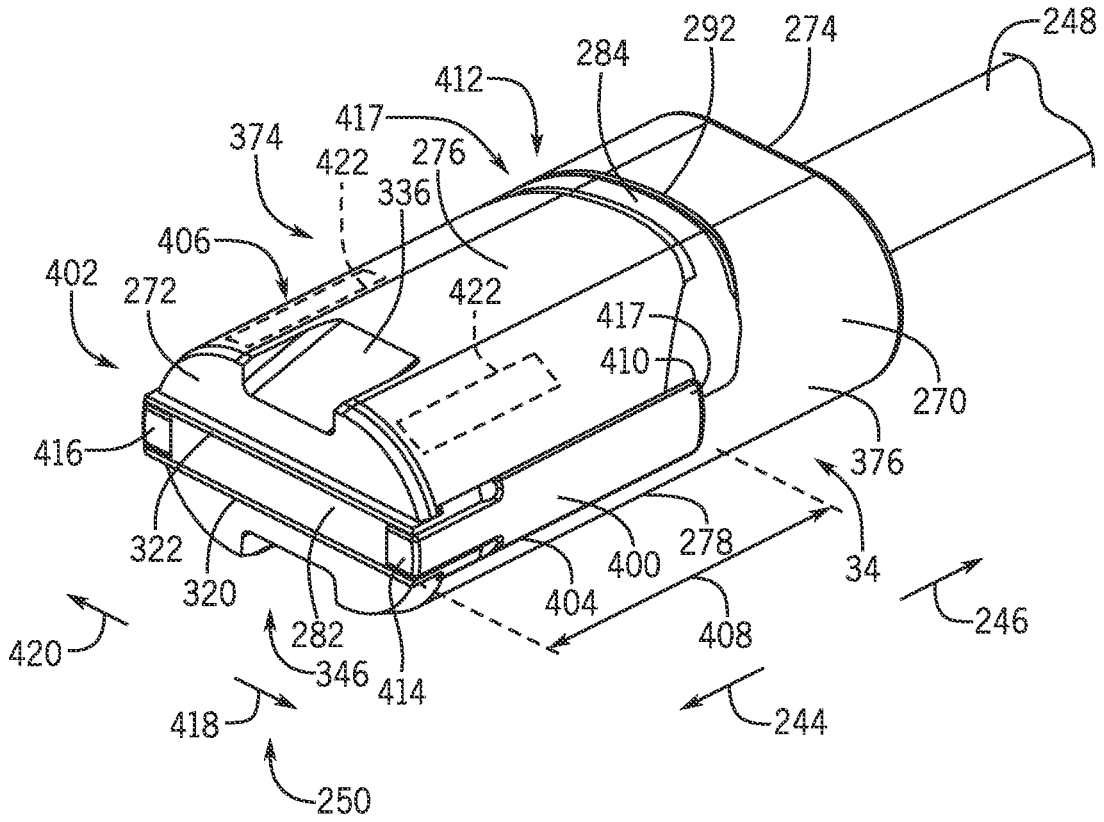
FIG. 35 is a perspective view of a ram of the flow control device of FIG. 32 in accordance with an embodiment of the present disclosure.

FIG. 35 is a perspective view of the ram 34 of the flow control device depicted in FIG. 32. As explained above, the ram 34 includes the seal system 250 that enables the ram 34 to seal with the housing 238 to block the flow of fracturing fluid through the bore 240. The seal system 250 includes the front seal 282 and the upper seal 284. In addition to these seals, the seal system 250 includes side seals 400 and 402 that rest within respective grooves/recesses 404 and 406 in the body 270. The side seals 400 and 402 are also elastomeric seals (e.g., nitrile, hydrogenated nitrile) that seal against the housing 238. The side seals 400 and 402 may extend a distance 408 along the body 270. In FIG. 35, this distance 408 is less than the entire length of the body 270. However, in some embodiments the side seals 400 and 402 may extend along the entire length of the body 270.

In order to form a seal about the bore 240, the side seals 400 and 402 contact the upper seal 284. As illustrated, the upper seal 284 curves over the upper surface 276 until it engages the side seals 400 and 402. In some embodiments, the upper seal 284 may include notches/grooves 410 and 412 at respective ends of the upper seal 284. These notches/grooves 410 and 412 in the upper seal 284 receive and contact respective portions 417 of the side seals 400 and 402. In other embodiments, however, the upper seal 284 does not include notches/grooves 410 and 412.

The side seals 400 and 402 are energized by contact between end surfaces 414 and 416 and the housing 238. As illustrated, the end surfaces 414, 416 extend beyond the front face 272 of the body 270. In operation, the end surfaces 414 and 416 contact the housing 238 as the ram 34 moves in axial direction 244 (i.e., surface 288). As the ram 34 continues to move in axial direction 244, the side seals 400 and 402 compress. The compression drives the side seals 400 and 402 radially outward in directions 418 and 420 forming a seal with the housing 238. The side seals 400 and 402 also compress against the upper seal 284, which energizes the top seal 284 as well. Specifically, the portions 417 of the side seals 400 and 402 that rest within the notches/grooves 410 and 412 of the upper seal 284 transfer energy to the upper seal 284 energizing the upper seal 284 to seal with the housing 238.

In some embodiments, the ram 34 may include wear pads 422. The wear pads 422 couple to the body 270 and form part of the upper surface 276. In operation, the wear pads 422 may reduce friction between the ram 34 and the housing 238 as the ram 34 opens and closes the bore 240. For example, the wear pads 422 may include Teflon, bronze, among other materials that have a coefficient of friction less than that of the body 270. The length of the wear pads 422 may extend over a portion of the length of the body 270 or they may extend between the front face 272 and the rear face 274 along the upper surface 276. In some embodiments, the lower surface 278 may include one or more wear pads 422 as well. Instead of, or in addition to, using wear pads 422, the body 270 may be formed of a softer material (e.g., stainless steel) to prevent galling of the housing 238 (e.g., along the cavity surface 290).

Figure 36:
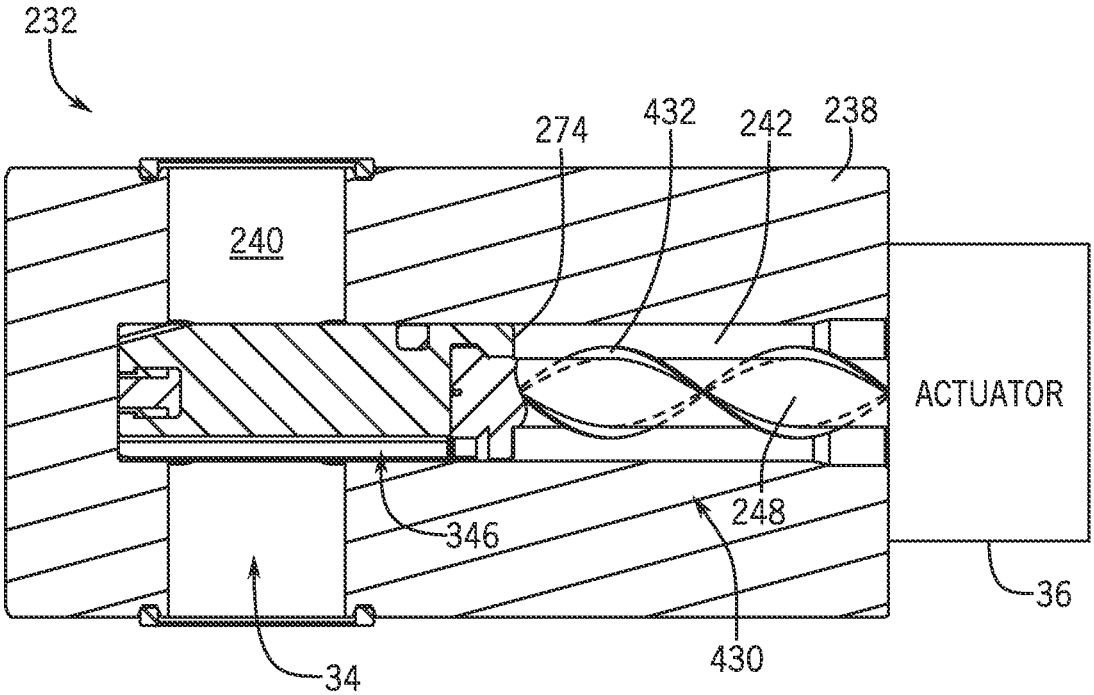
FIG. 36 is a cross-sectional view of a flow control device in a closed position in accordance with an embodiment of the present disclosure.

FIG. 36 is a cross-sectional view of a flow control device 232 in a closed position. Over time, the flow of fracturing fluid through the flow control device 232 may result in the accumulation of proppant (e.g., sand) in the cavity 242. To facilitate removal of the proppant within the cavity 242, the flow control device 232 may include an agitator 430 that breaks up proppant so that fluid is able to carry the proppant out of the cavity 242 through the groove/slot 346. In some embodiments, the agitator 430 may also push the proppant out of the cavity 242 as the ram 34 moves axially in direction 244. The agitator 430 may include one or more blades 432 that extend from the shaft 248. These blades 432 may wrap around the shaft 248 in spiral or helical manner. In this way, as the shaft 248 moves axially, the blades 432 push or breakup proppant piles to facilitate removal. In some embodiments, the shaft 248 may move axially while rotating, enabling the blades 432 to cut into accumulated piles of proppant, breaking it up to facilitate its removal. The blades 432 may extend along the length of the shaft 248 or a portion of the shaft 248. For example, the blades 432 may extend from the rear face 274 to the actuator 36. In some instances, proppant may also or instead be flushed from the cavity 242 by injecting water or another fluid into the cavity 242 (e.g., through ports in the housing 238 or from the actuator 36).

Figure 37:
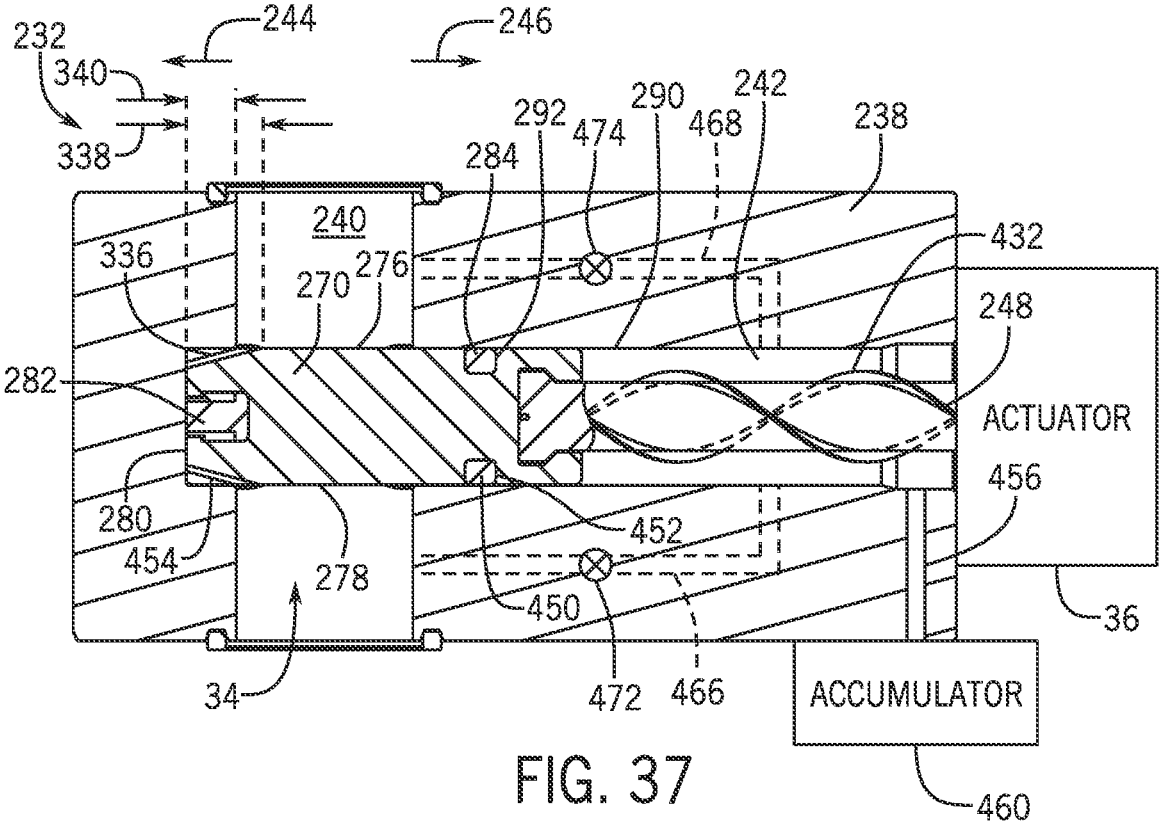
FIG. 37 is a cross-sectional view of a flow control device in accordance with an embodiment of the present disclosure.

FIG. 37 is a cross-sectional view of a flow control device 232. As explained above, the flow control device 232 controls the flow of fracturing fluid. The seal system 250 enables the flow control device 232 to form seals with the housing 238 without using valve seats. However, the flow of sand in the fracturing fluid may result in the buildup of sand in the cavity 242. To reduce or prevent the buildup of proppant in the cavity 242, the ram 34 may include a bottom seal 450 within a groove 452 of the lower surface 278. The bottom seal 450 is also an elastomeric seal (e.g., nitrile, hydrogenated nitrile) that seals against the housing 238. As illustrated, the bottom seal 450 engages and seals against a surface 290 (i.e., cavity surface) that defines the cavity 242.

The ram 34 may also include one or more grooves/slots in the body 270. For example, as shown in FIG. 37, the body 270 may define a groove/slot 336 in the upper surface 276 and another groove/slot 454 in the lower surface 278. These grooves/slots 336 and 454 may facilitate evacuation of sand from the recess 280 and reduce interference from sand on movement of the ram 34 into and out of the recess 280. In some embodiments, the grooves/slots 336, 454 may have a length 338 that is greater than a depth/length 340 of the recess 280 to facilitate movement of proppant out of the recess 280. In still other embodiments, one or both of the grooves/slots 336 and 454 may also be angled. By angling the grooves/slots 336, 454, the grooves/slots 336 and 454 may enable proppant to slide off the ram 34.

Because of the high pressures used during hydraulic fracturing operations, hydraulic fluid including proppant may enter the cavity 242. In order to remove the proppant as well as enable the ram 34 to retract, the housing 238 may include one or more apertures 456. The apertures 456 couple to one or more accumulators 460 that receive proppant and fluid within the cavity 242. The accumulators 460 enable sand and fluid in the cavity 242 to flow out of the cavity 242 through the apertures 456 as the ram 34 moves in axial direction 246. In this way, the flow control device 232 may use little to no grease during operation while still controlling the flow of fracturing fluid into and out of the well 12. In other words, the flow control device 232 may not include grease in the cavity 242 to block proppant from entering the cavity 242.

In some embodiments, the housing may include apertures 466 and 468 that couple the cavity 242 to the bore 240 below and above the ram 34. Fluid flow through these apertures 466 and 468 is controlled by respective valves 472 and 474. In operation, these apertures 466 and 468 may enable pressure in the bore 240 to assist in closing the ram 34 or to enable fluid to escape the cavity 242 when opening/retracting the ram 34. For example, if pressurized fluid is flowing through the bore 240 in direction 372, the valve 474 may be opened and the valve 472 closed in order to use the pressure of the fluid in the bore 240 to increase the closing force on the ram 34 (e.g., supplement the force from the actuator 36). The opposite would occur if the pressurized fluid were flowing through the bore 240 in direction 370. It should also be understood that regardless of the fluid flow direction, the valves 472 and 474 may be controlled to facilitate closing depending on which side of the ram 34 the bore 240 should be sealed on. In other words, sealing the area below the ram 34 would involve opening valve 472 and closing valve 474, while sealing the area above the ram 34 would involve opening valve 474 and closing valve 472.

The valves 472 and 474 and apertures 466 and 468 may facilitate opening of the ram 34 as well. As explained above, fluid may accumulate in the cavity 242. In order to open the ram 34, the fluid in the cavity 242 is vented as the ram 34 retracts. In some embodiments, all of the valves 472 and 474 may be opened to enable fluid to vent from the cavity 242 when retracting the ram 34. In another embodiment, one of the valves 472 and 474 may be opened to vent. For example, if the pressure in the bore 240 above the ram 34 is greater than the pressure below the ram 34, the valve 472 may be opened and the valve 474 remains closed to facilitate venting fluid from the cavity 242. Likewise, if the pressure in the bore 240 above the ram 34 is less than the pressure below the ram 34 then the valve 474 may be opened and the valve 472 closed while venting fluid from the cavity 242. In this way, fluid communication between the cavity 242 and the bore 240 may facilitate opening and closing of the ram 34. Also, the flow control device 232 may use little to no grease during operation while still controlling the flow of fracturing fluid into and out of the well 12.

Figure 38:
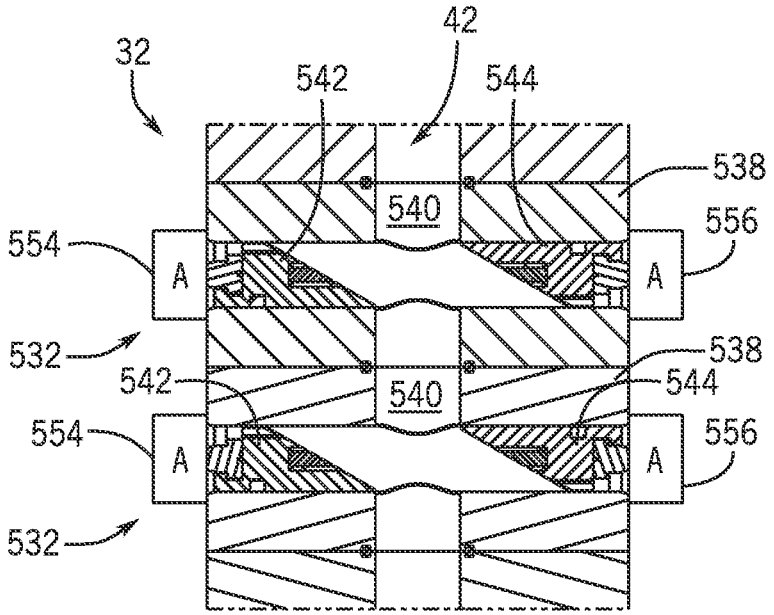
FIG. 38 depicts a frac stack having flow control devices with sealing rams in accordance with one embodiment.

Still another example of a frac stack 32 having sealing rams is shown in FIG. 38. In this example, the body of the frac stack 32 includes stacked flow control devices 532 with sealing rams that can be opened and closed with actuators (e.g., electric actuators, pneumatic actuators, hydraulic actuators, manual actuators, or a combination thereof). The sealing rams are depicted as wedge rams 542 and 544 that can be used to control flow of fracturing or other fluid through the frac stack 32. As discussed above with respect to FIG. 29, various additional components (e.g., goat head 26 and wing valves 28 and 30) can be used to control or otherwise facilitate flow through the frac stack 32 and the flow control devices 532 of the frac stack body can be connected to one another and to other equipment in any suitable manner. And as also noted above for FIG. 29, while two flow control devices 532 are shown in FIG. 38, the frac stack 32 may include some other number of flow control devices 532, such as between three and six flow control devices 532 or just a single flow control device 532. The flow control devices 532 may be used for large bore (e.g., seven-inch) and high pressure (e.g., 15,000 psi) applications. In some embodiments, the flow control devices 532 are used in place of lower and upper master gate valves in a fracturing tree. A frac stack 32 may include a combination of flow control devices 232 and 532 in some instances. Still further, the flow control device 532 could be used apart from the frac stack in other fracturing operations or could be used in other (i.e., non-fracturing) flow control contexts in other embodiments.

Figure 39:
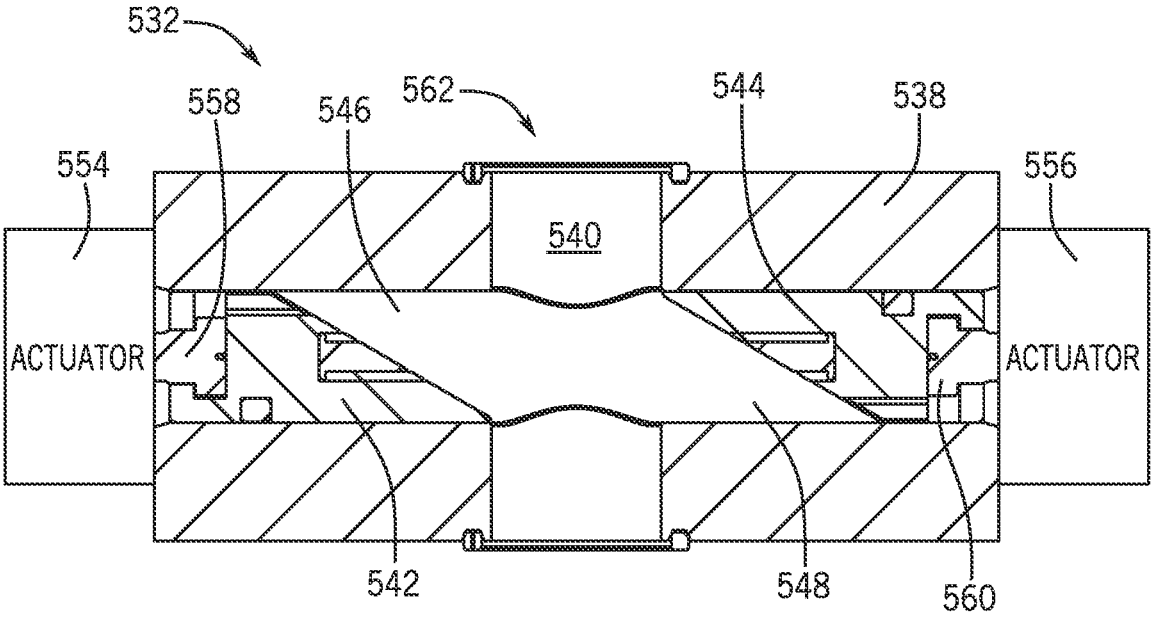
FIG. 39 is a cross-sectional view of one of the flow control devices of FIG. 38 in an open position in accordance with an embodiment of the present disclosure.

FIG. 39 is a cross-sectional view of one of the flow control devices 532 of FIG. 38 in an open position. The flow control device 532 includes a housing 538 with a bore 540 for conveying fluid through the housing 538. The flow of fluid through the bore 540 is controlled with first and second wedge rams 542 and 544. The wedge rams 542 and 544 rest within respective first and second cavities 546 and 548 of the housing 538 and move axially in directions 550 and 552 (FIG. 40) to open and close the bore 540. In an open position, the wedge rams 542 and 544 are completely withdrawn out of the bore 540 enabling fracturing fluid to flow through the housing 538 and into the well 12. As explained above, fracturing fluid includes proppant (e.g., sand) in order to prop open cracks formed under pressure so that hydrocarbons can flow out of a formation. Accordingly, by retracting the wedge rams 542 and 544 out of the bore 540, the wedge rams 542 and 544 are not exposed to the direct flow path of the fracturing fluid through the housing 538, which may reduce erosion and wear on the wedge rams 542 and 544.

The axial position of the wedge rams 542 and 544 are controlled with respective first and second actuators 554 and 556. The actuators 554 and 556 may be electric actuators, pneumatic actuators, hydraulic actuators, manual actuators, or a combination thereof. The first actuator 554 couples to the first wedge ram 542 with a first shaft 558, and the second actuator 556 couples to the second wedge ram 544 with a second shaft 560. As will be explained below, the flow control device 532 includes a seal system 562 that enables the first and second wedge rams 542 and 544 to form a seal with the housing 538 without valve seats.

Figure 40:
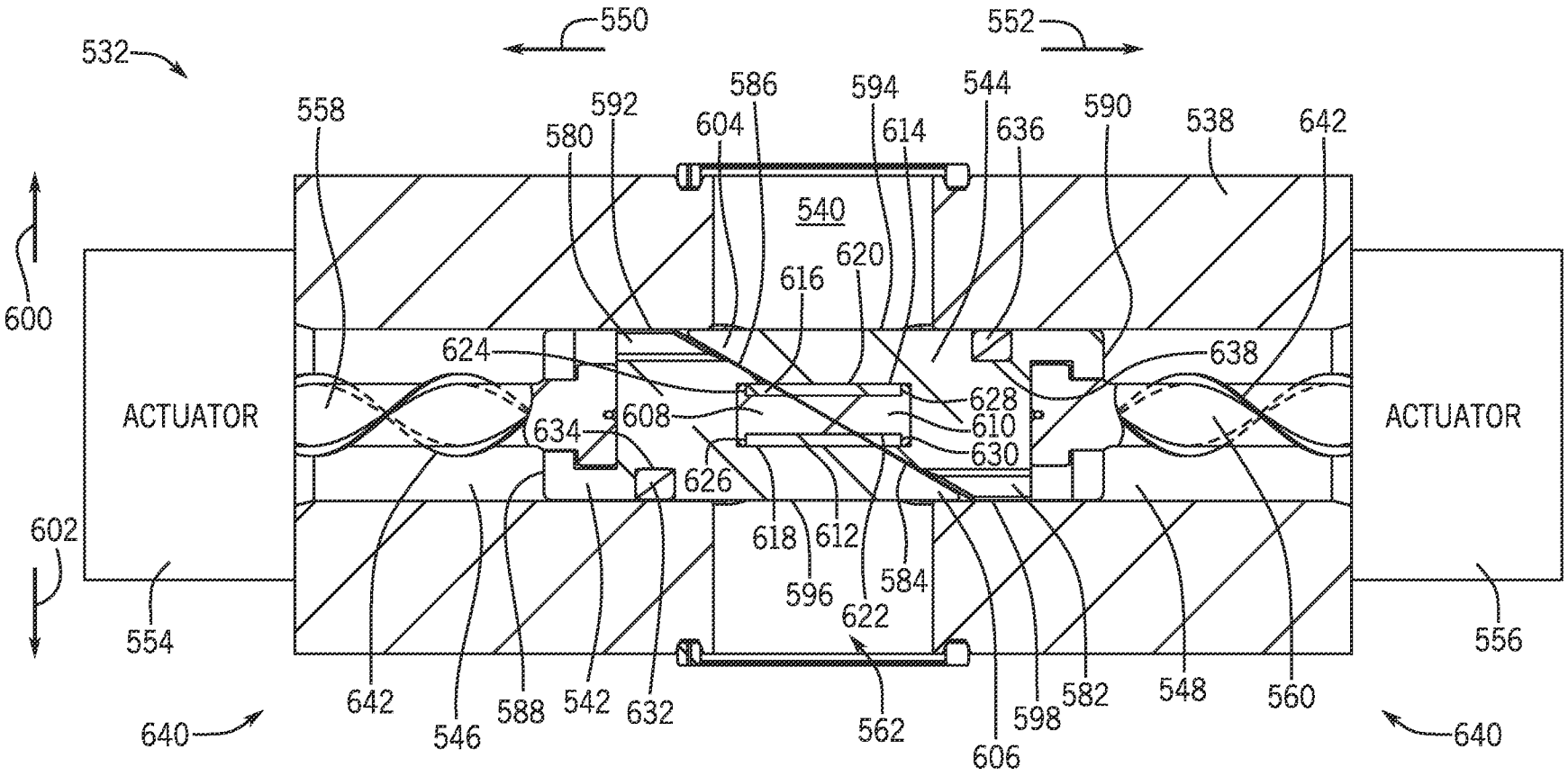
FIG. 40 is a cross-sectional view of the flow control device of FIG. 39 in a closed position in accordance with an embodiment of the present disclosure.

FIG. 40 is a cross-sectional view of the flow control device 532 in a closed position. The first and second wedge rams 542 and 544 include respective bodies 580 and 582 that support the seal system 562. The bodies 580 and 582 include respective angled front faces 584 and 586; rear faces 588 and 590; upper surfaces 592 and 594; and lower surfaces 596 and 598. In the closed position, the angled front faces 584 and 586 contact each other to close the bore 540. In addition to contacting each other, a portion of each front face 584 and 586 rests in the cavity of the opposing ram. That is, a portion of the first wedge ram 542 enters the second cavity 548, and a portion of the second wedge ram 544 rests within the first cavity 546. In this arrangement, the flow control device 532 is able to maintain a seal within the bore 540 regardless of whether pressurized fluid flows through the bore 540 in axial direction 600 or 602.

In operation, the actuator 554 drives the shaft 558 coupled to the first wedge ram 542 in axial direction 552 and the actuator 556 drives the shaft 560 coupled to the second wedge ram 544 in axial direction 550. As the front faces 584 and 586 of the respective first and second wedge rams 542 and 544 contact each other, the front faces 584 and 586 slide over each other. As the front faces 584 and 586 slide over each other, the first wedge ram 542 creates a force in direction 600 on the second wedge ram 544 that wedges an end portion 604 of the second wedge ram 544 between the housing 538 and the first wedge ram 542. Likewise, the sliding motion enables the second wedge ram 544 to generate a force in direction 602 on the first wedge ram 542 that wedges an end portion 606 of the first of the first wedge ram 542 between the housing 538 and the second wedge ram 544.

As explained above, the flow control device 532 includes the seal system 562, which forms a seal between the first and second wedge rams 542 and 544 and between the wedge rams 542, 544 and the housing 538. The seal system 562 includes front seals 608 and 610 (i.e., elastomeric seals such as nitrile seals, hydrogenated nitrile seals). These front seals 608 and 610 (e.g., wedge seals) rest and are retained within respective slots 612 and 614 of the first and second wedge rams 542 and 544.

In some embodiments, the seal system 562 may include energizing plates that drive the front seals 608 and 610 in respective directions 552 and 550. For example, the first wedge ram 542 may include energizing plates 616 and 618, and the second wedge ram 544 may include energizing plates 620 and 622. These plates 616, 618, 620, and 622 may be made out of metal or another material that is more rigid than the elastomeric material of the front seals 608 and 610. The energizing plates 616, 618, 620, and 622 are placed on opposite sides of their respective front seals 608 and 610. In some instances, the energizing plates 616 and 618 are configured to extend beyond the front face 584 of the first wedge ram 542 and the energizing plates 620 and 622 are configured to extend beyond the front face 586 of the second wedge ram 544. For example, the energizing plates 616, 618, 620, and 622 may extend between 1 mm and 20 mm beyond the respective front faces 584 and 586.

In operation, as the first and second wedge rams 542 and 544 contact each other the energizing plates 616 and 618 are driven in direction 550 (relative to the ram 542) and the energizing plates 620 and 622 are driven in direction 552 (relative to ram 544). As the energizing plates 616 and 618 move in direction 550, they engage ledges 624 and 626 on the elastomeric front seal 608. The force of the energizing plates 616 and 618 on the elastomeric front seal 608 flows through it and drives the elastomeric front seal 608 in axial direction 552. In other words, the force of the energizing plates 616 and 618 energizes the elastomeric front seal 608 in axial direction 552 and radially outward against the housing 538 increasing the sealing force of the elastomeric front seal 608 against the second wedge ram 544 and the housing 538.

Likewise, as the first and second wedge rams 542 and 544 contact each other the energizing plates 620 and 622 are driven in direction 552. As the energizing plates 620 and 622 move in direction 552, they engage ledges 628 and 630 on the elastomeric front seal 610. The force of the energizing plates 620 and 622 on the elastomeric front seal 610 flows through it and drives the elastomeric front seal 610 in axial direction 550. That is, the force of the energizing plates 620 and 622 energizes the elastomeric front seal 610 in axial direction 550 and radially outward against the housing 538 increasing the sealing force of the elastomeric front seal 610 against the first wedge ram 542 and the housing 538. The energizing plates 616, 618, 620, and 622 may also limit or prevent extrusion of the elastomeric front seals 608 and 610 (e.g., along the front faces 584 and 586) when closing the wedge rams 542 and 544.

In some embodiments, the wedge ram 542 may include ledges that engage the ledges 624 and 626 on the first wedge seal 608. The wedge ram 544 may also include ledges that engage the ledges 628 and 630 on the second wedge seal 610. These ledges on the wedge rams 542, 544 facilitate retention of the wedge seals 608 and 610 during operation.

As illustrated, the first wedge ram 542 includes a lower seal 632 that rests and is retained within a groove 634 in the lower surface 596. The lower seal 632 engages and seals against the housing 538 within the cavity 546. The second wedge ram 544 includes an upper seal 636 that rests and is retained within a groove 638 in the upper surface 594. The upper seal 636 engages and seals against the housing 538 within the cavity 548. Together the lower seal 632, upper seal 636, first front seal 608, and second front seal 610 form part of seal system 562 that seals between the first and second wedge rams 542, 544 and between these wedge rams 542, 544 and the housing 538 to block the flow of fracturing fluid through the bore 540. It should be understood that the lower seal 632 and the upper seal 636 are also elastomeric seals (e.g., nitrile, hydrogenated nitrile). By including elastomeric seals in the seal system 562, the flow control device 532 is able to form seals that block the flow of fracturing fluid through the bore 540 without using valve seats. Furthermore, because elastomeric seals may be less susceptible to pitted surfaces, including elastomeric seals in the flow control device 532 may facilitate sealing in an erosive hydraulic fracturing environment. Accordingly, instead of forming a metal-to-metal seal between a ram and valve seats, the elastomeric seals of the flow control device 532 enable seal formation between the first and second wedge rams 542, 544 and the housing 538.

Over time, the flow of fracturing fluid through the flow control device 532 may result in the accumulation of proppant (e.g., sand) in the cavities 546, 548. To facilitate removal of the proppant from the cavities 546, 548, the flow control device 532 may include one or more agitators 640 that breaks up proppant to facilitate removal. In some embodiments, the agitator 640 may also push the proppant out of the cavities 546, 548 as the first or second wedge rams 542, 544 move axially. In some embodiments, the agitator 640 may include one or more blades 642 that extend about the shafts 558 and 560. These blades 642 may wrap around the shafts 558 and 560 in a spiral or helical manner. In this way, as the shafts 558 and 560 rotate, the blades 642 cut into accumulated piles of proppant, breaking it up to facilitate removal. The blades 642 may extend along the length of the shafts 558, 560 or a portion of the shafts 558, 560. In some instances, proppant may also or instead be flushed from the cavities 546, 548 by injecting water or another fluid into the cavities 546, 548 (e.g., through ports in the housing 538 or from the actuators 554, 556).

Figure 41:
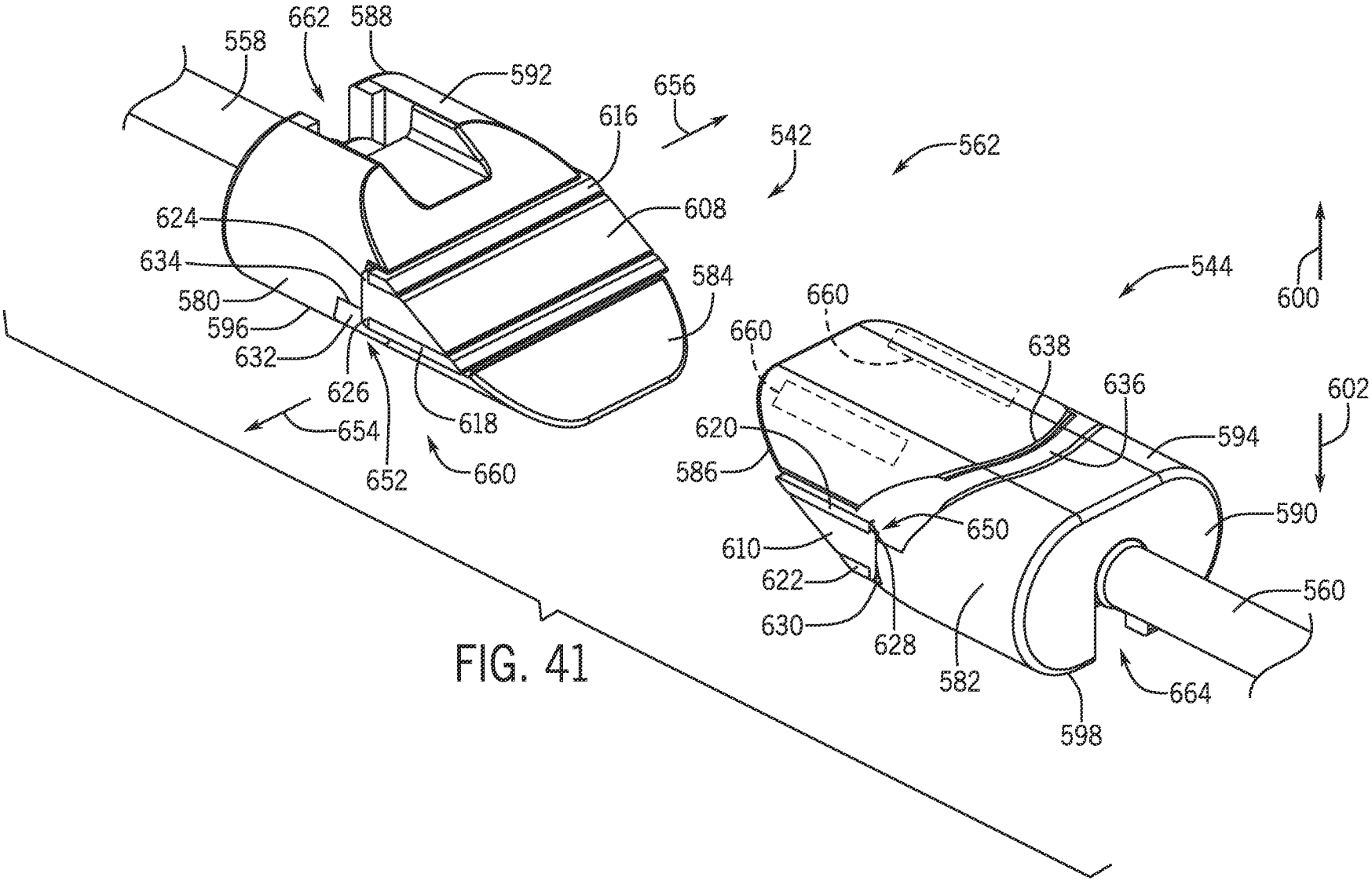
FIG. 41 is a perspective view of wedge rams of the flow control device of FIG. 38 in accordance with an embodiment of the present disclosure.

FIG. 41 is a perspective view of the first and second wedge rams 542 and 544. As explained above, the flow control device 532 includes the seal system 562 that enables the rams 542, 544 to form seals with the housing 538 to block the flow of fracturing fluid through the bore 540. As illustrated, the front seals 608 and 610 extend along the sides of the first and second wedge rams 542 and 544. In this way, the front seals 608 and 610 enable sealing along the sides of the respective ram bodies 580 and 582. Furthermore, and in some embodiments, the front seals 608 and 610 seal with and energize the lower seal 632 and the upper seal 636. As illustrated, the upper seal 636 curves over the upper surface 594 until it engages (e.g., contacts) the front seal 610. Similarly, the lower seal 632 curves over lower surface 596 and engages (e.g., contacts) the front seal 608. In some embodiments, the upper seal 636 and lower seal 632 may include respective notches/grooves 650, 652 that receive and contact respective portions of front seals 610 and 608. But the upper seal 636 and lower seal 632 do not include respective notches/grooves 650, 652 in some other embodiments.

The lower seal 632 and upper seal 636 are energized by contact with respective front seals 608, 610. As explained above, as the front faces 584 and 586 of the first and second wedge rams 542 and 544 contact each other they energize the front seals 608 and 610 with the energizing plates 616, 618, 620, and 622. The compression of the front seals 608 and 610 drives the front seals 608 and 610 radially outward in directions 654, 656 and towards the opposing wedge ram, as well as compresses/energizes the respective lower seal 632 and upper seal 636. More specifically, force from the front seal 608 is transferred to the lower seal 632, which compresses and is driven in direction 602 and into sealing contact with the housing 538. Likewise, force from the front seal 610 is transferred to the upper seal 636, which compresses and is driven in direction 600 and into sealing contact with the housing 538. Furthermore, the force on the respective front faces 584 and 586 generated from the front faces 584 and 586 sliding over one another blocks the lower seal 632 and the upper seal 636 from de-energizing from their respective sealing contact surfaces because a portion of the front faces 584 and 586 rests in the cavity of the opposing ram. In this arrangement, the flow control device 532 is able to maintain a seal in both directions 600 and 602 within the bore 540 regardless of whether pressurized fluid flows through the bore 540 in axial direction 600 or 602.

In some embodiments, the first and second wedge rams 542, 544 may include wear pads 660. In operation, the wear pads 660 may reduce friction between the first and second wedge rams 542 and 544 and the housing 538 as the first and second wedge rams 542 and 544 open and close the bore 540. For example, the wear pads 660 may include Teflon, bronze, or other materials with a coefficient of friction less than that of the material of the bodies 580 and 582. The length of the wear pads 660 may extend over a portion of the length of the bodies 580 and 582 or they may extend along their entire length. It should be understood that wear pads 660 may couple to the both the upper surfaces 592, 594 and lower surfaces 596, 598 of the wedge rams 542, 544. Instead of, or in addition to, using wear pads 660, the bodies 580 and 582 may be formed of a softer material (e.g., stainless steel) to prevent galling of the housing 538 (e.g., along surfaces defining cavities 546 and 548).

As explained above, the flow control device 532 controls the flow of high-pressure fracturing fluid through the bore 540. Fracturing fluid contains proppant (e.g., sand) that props open cracks created by the pressurized fracturing fluid after the fracturing fluid is depressurized. To facilitate the removal of sand or to block the buildup of sand within the flow control device 532 and to facilitate opening of the flow control device 532, the first and second wedge rams 542 and 544 may include one or more grooves/slots in their respective bodies 580 and 582. For example, the body 580 may define a groove/slot 662 in the upper surface 592. This groove/slot 662 extends from the front face 584 to the rear face 588 enabling fluid to flow and equalize pressure in the cavity 546. Similarly, the body 582 may define a groove/slot 664 in the lower surface 598. This groove/slot 664 extends from the front face 586 to the rear face 590 enabling fluid to flow and equalize pressure in the cavity 548 as well as facilitate removal of sand buildup in the cavity 548.

Figure 42:
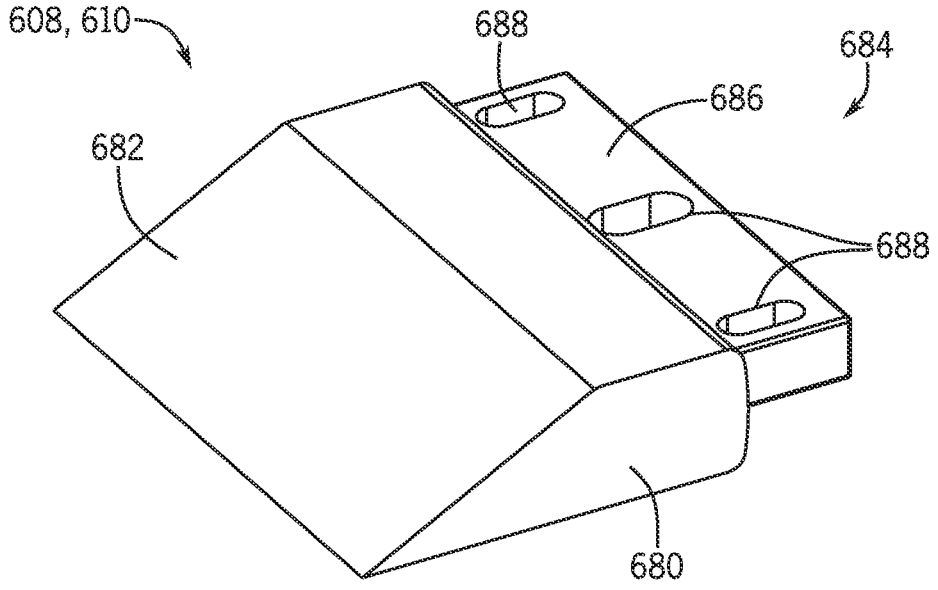
FIG. 42 is a perspective view of a wedge seal in accordance with an embodiment of the present disclosure.

FIG. 42 is a perspective view of an embodiment of the front seals 608, 610 (e.g., wedge seals). The front seals 608, 610 include an elastomer body 680 with an angled surface 682 configured to seal against each other. In some embodiments, the front seals 608, 610 may also include a retention feature 684 that facilitates coupling of the front seals 608, 610 to the wedge rams 542, 544. The retention feature 684 may include a block 686 of resilient material (e.g., metal) embedded in the body 680. The block 686 defines one or more apertures 688 (e.g., 1, 2, 3, 4, 5) that are configured to receive a pin that couples the front seal 608, 610 to the bodies 580, 582 of the wedge rams 542, 544.

Figure 43:
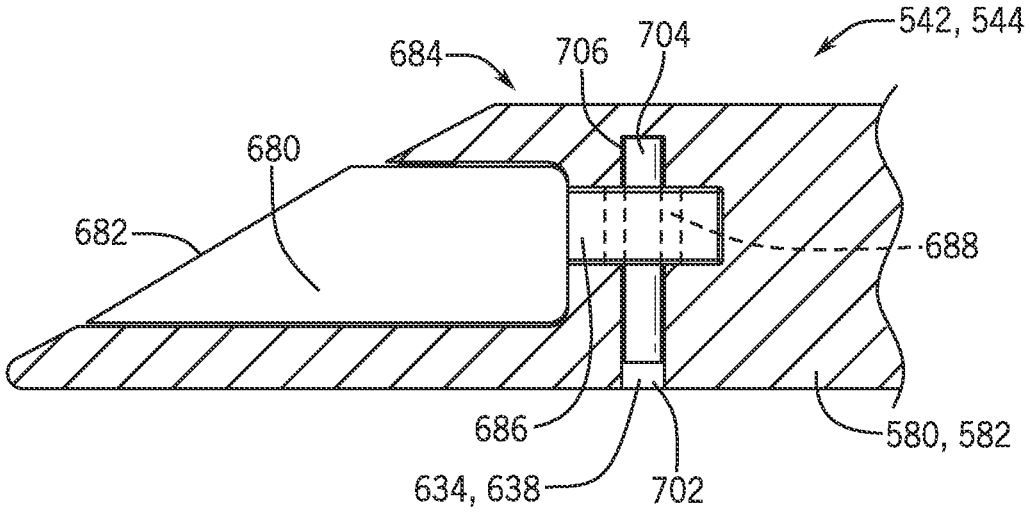
FIG. 43 is a cross-sectional view of a ram in accordance with an embodiment of the present disclosure.

FIG. 43 is a cross-sectional view of a wedge ram 542, 544 with a front seal 608, 610. As illustrated, the front seal 608, 610 is inserted into the body 580, 582 until the apertures 688 in the retention feature 684 align with a pin aperture 702. A pin 704 may then be inserted through the pin aperture 702 and through the aperture 688 in the retention feature 684 and into a recess 706 in the body 580, 582. In this way, the surfaces of the body 580, 582 that define the recess 706 and the aperture 702 reduce or block movement of the pin 704 in axial directions 550, 552. As illustrated, the aperture 688 in the block 686 is larger than the pin 704. This enables the front seal 608, 610 to move in response to changes in pressure on the front seal 608, 610 as the flow control device 532 opens and closes. In some embodiments, the pin 704 may be molded into the lower and upper seals 632, 636 that rest within respective grooves 634, 638.

Figure 44:
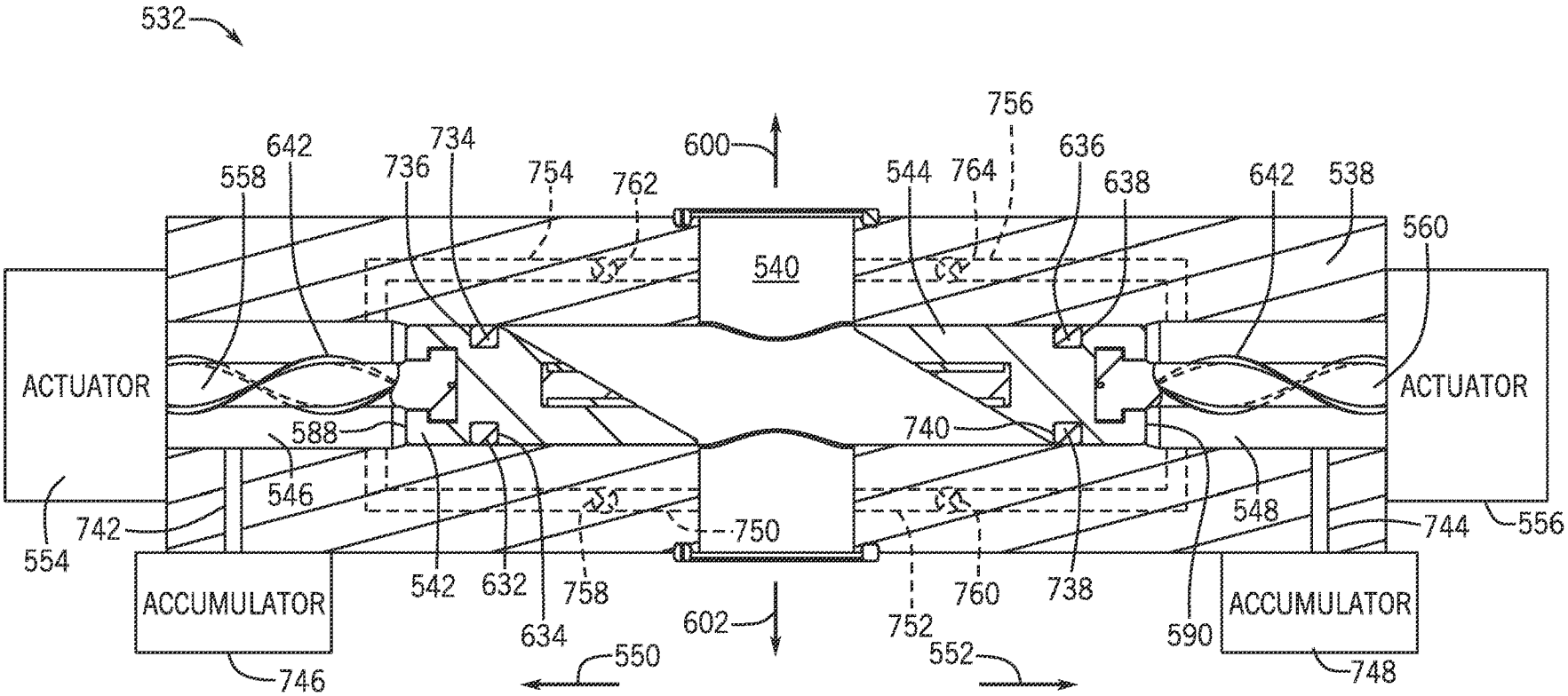
FIG. 44 is a cross-sectional view of a flow control device in an open position in accordance with an embodiment of the present disclosure.

FIG. 44 is a cross-sectional view of a flow control device 532 in an open position. To reduce or block the buildup of proppant in the cavities 546, 548, the first wedge ram 542 may include an upper seal 734 in a groove 736 of the upper surface 592. The upper seal 734 works with the lower seal 632 to form a seal about the cavity 546 to block proppant from entering the cavity 546. Similarly, the second wedge ram 544 may include a lower seal 738 in a groove 740 of the lower surface 598. The lower seal 738 in combination with the upper seal 636 form a seal about the cavity 548 to block proppant from entering the cavity 548. By creating a seal about the cavities 546 and 548, the seals 734 and 738 may block or reduce pressure equalization in the cavities 546 and 548.

To facilitate pressure equalization in the cavities 546 and 548, the housing 538 may include one or more apertures 742 and 744 in the housing 538. The aperture 742 couples one or more accumulators 746 to the cavity 546 to receive fluid. More specifically, fluid in the cavity 546 is able to flow out of the cavity 546 through the apertures 742 as the first wedge ram 542 moves in axial direction 550. Likewise, aperture 744 couples one or more accumulators 748 to the cavity 548 to receive fluid as the second wedge ram 544 moves in axial direction 552. In some embodiments, the accumulators 746 and 748 may also pump fluid into the respective cavities 546 and 548 to increase the force on the wedge rams 542 and 544. In other words, the accumulators 746 and 748 may provide pressurized fluid that supplements (i.e., generate additional force on the rear faces 588 and 590) or replaces the force from the actuators 554 and 556.

In still other embodiments, the flow control device 532 may include apertures 750 and 752 that couple the cavities 546 and 548 to the bore 540 below the wedge rams 542, 544, as well as apertures 754 and 756 that couple the cavities 546 and 548 to the bore 540 above the wedge rams 542, 544. Fluid flow through these apertures 750, 752, 754, and 756 is controlled by respective valves 758, 760, 762, and 764. In operation, these apertures 750, 752, 754, and 756 may enable pressure in the bore 540 to assist in closing the wedge rams 542, 544 or to enable fluid to escape the cavities 546, 548 when opening the wedge rams 542, 544. For example, if pressurized fluid is flowing through the bore 540 in direction 600, the valves 758 and 760 may be opened and the valves 762 and 764 closed in order to use the pressure of the fluid in the bore 540 to increase the closing force on the wedge rams 542, 544 (e.g., supplement the force from the actuators 554 and 556). The opposite may occur if the pressurized fluid were flowing through the bore 540 in direction 602. It should also be understood that regardless of the fluid flow direction, the valves 758, 760, 762, and 764 may be controlled to facilitate closing depending on which side of the wedge rams 542, 544 the bore 540 should be sealed on. In other words, sealing the area below the wedge rams 542, 544 would involve opening valves 758, 760 and closing valves 762, 764, while sealing the area above the wedge rams 542, 544 would involve opening valves 762, 764 and closing valves 758, 760.

The valves 758, 760, 762, and 764 and apertures 750, 752, 754, and 756 may facilitate opening of the wedge rams 542 and 544 as well. As explained above, fluid may accumulate in the cavities 546 and 548. In order to open the wedge rams 542 and 544, the fluid in the cavities 546 and 548 is vented as the wedge rams 542, 544 retract. In some embodiments, all of the valves 758, 760, 762, and 764 may be opened to enable fluid to vent from the cavities 546 and 548 when retracting the wedge rams 542, 544. In another embodiment, a subset of the valves 758, 760, 762, and 764 may be opened to vent. For example, if the pressure in the bore 540 above the wedge rams 542, 544 is greater than the pressure below the wedge rams 542, 544 the valves 758 and 760 may be opened and the valves 762 and 764 may remain closed to facilitate venting fluid from the cavities 546, 548. Likewise, if the pressure in the bore 540 above the wedge rams 542, 544 is less than the pressure below the wedge rams 542, 544 then the valves 762 and 764 may be opened and the valves 758 and 760 closed while venting fluid from the cavities 546 and 548. In this way, fluid communication between the cavities 546, 548 and the bore 540 may facilitate opening and closing of the wedge rams 542, 544. Also, the flow control device 532 may use little to no grease during operation while still controlling the flow of fracturing fluid into and out of the well 12.

From the discussion above, it will be appreciated that a fracturing system in one embodiment includes a wellhead and a frac stack coupled to the wellhead. The frac stack can include a flow control device that can move between open and closed positions to open and close a bore for conveying a fracturing fluid, and the flow control device can include a housing defining a first cavity, a second cavity, and the bore. A first wedge ram can move axially within the first cavity and a second wedge ram can move axially within the second cavity. In the closed position, a first portion of the first wedge ram rests within the second cavity and a second portion of the second wedge ram rests within the first cavity. The wedge rams can include elastomer wedge seals. First and second plates for energizing an elastomer wedge seal may be received in a slot of a wedge ram. An elastomer wedge seal can have an aperture for receiving a pin to block removal of the wedge seal from a wedge ram. The first wedge ram can have an upper surface with a groove that enables fluid communication between the bore and the first cavity. The first wedge ram can have a lower surface with a seal groove for receiving a lower elastomeric seal for sealing with the housing inside the first cavity. The second wedge ram can have a lower surface with a groove that enables fluid communication between the bore and the second cavity. The second wedge ram can have an upper surface with a seal groove for receiving an upper elastomeric seal for sealing with the housing inside the second cavity.

In another embodiment, a system includes a flow control device that can move between open and closed positions to open and close a bore. The flow control device can include: a housing defining a first cavity, a second cavity, and the bore; a first wedge ram that can move axially within the first cavity; and a second wedge ram that can move axially within the second cavity. The first wedge ram can include a lower seal in a first groove on a lower surface and the second wedge ram can include an upper seal in a second groove on an upper surface. In the closed position, a first portion of the first wedge ram rests within the second cavity and a second portion of the second wedge ram rests within the first cavity. A wedge ram can include a slot for receiving an elastomer wedge seal. A wedge ram can include plates for contacting an opposing wedge ram and energizing an elastomer wedge seal of the wedge ram. The elastomer wedge seal can include an aperture for receiving a pin to block removal of the wedge seal from a wedge ram. The system may also include a shaft coupled to a wedge ram, and the shaft can include a blade for pushing or agitating proppant in the first or second cavity as the wedge ram moves axially. Additionally, the system can include an accumulator coupled to received fluid from the first or second cavity as the first or second wedge ram retracts.

In another embodiment, a system includes a first wedge ram that can move axially within a first cavity and a second wedge ram that can move axially within a second cavity. When the wedge rams are moved to a closed position, a first portion of the first wedge ram can rest within the second cavity and a second portion of the second wedge ram can rest within the first cavity to seal a bore. The system can include a housing defining the first cavity, the second cavity, and the bore. The first and second wedge rams can include elastomer wedge seals that engage one another to seal the bore. A wedge ram can include a groove that enables fluid communication between the bore and the first or second cavity.

Intervention tools may be run into wells to perform various functions. Such intervention tools can include perforating guns, setting tools (e.g., for plugs or seals), evaluation tools (e.g., logging tools, testing tools, sampling tools, or inspection tools), or cleanup tools, to name several examples. An intervention tool may be lowered into a well on a line, such as a wireline, a slickline, a braided line, or a coiled tubing line. Such lines may be reeled from a spool; in these cases, the lines and associated deployment equipment (e.g., spools, control units, sheaves, and motors) may be referred to as spool conveyance systems. The intervention tools, which may also be referred to as downhole tools, can be employed alone or in combination with other tools in a tool string lowered together into a well on a line.

Figure 45:
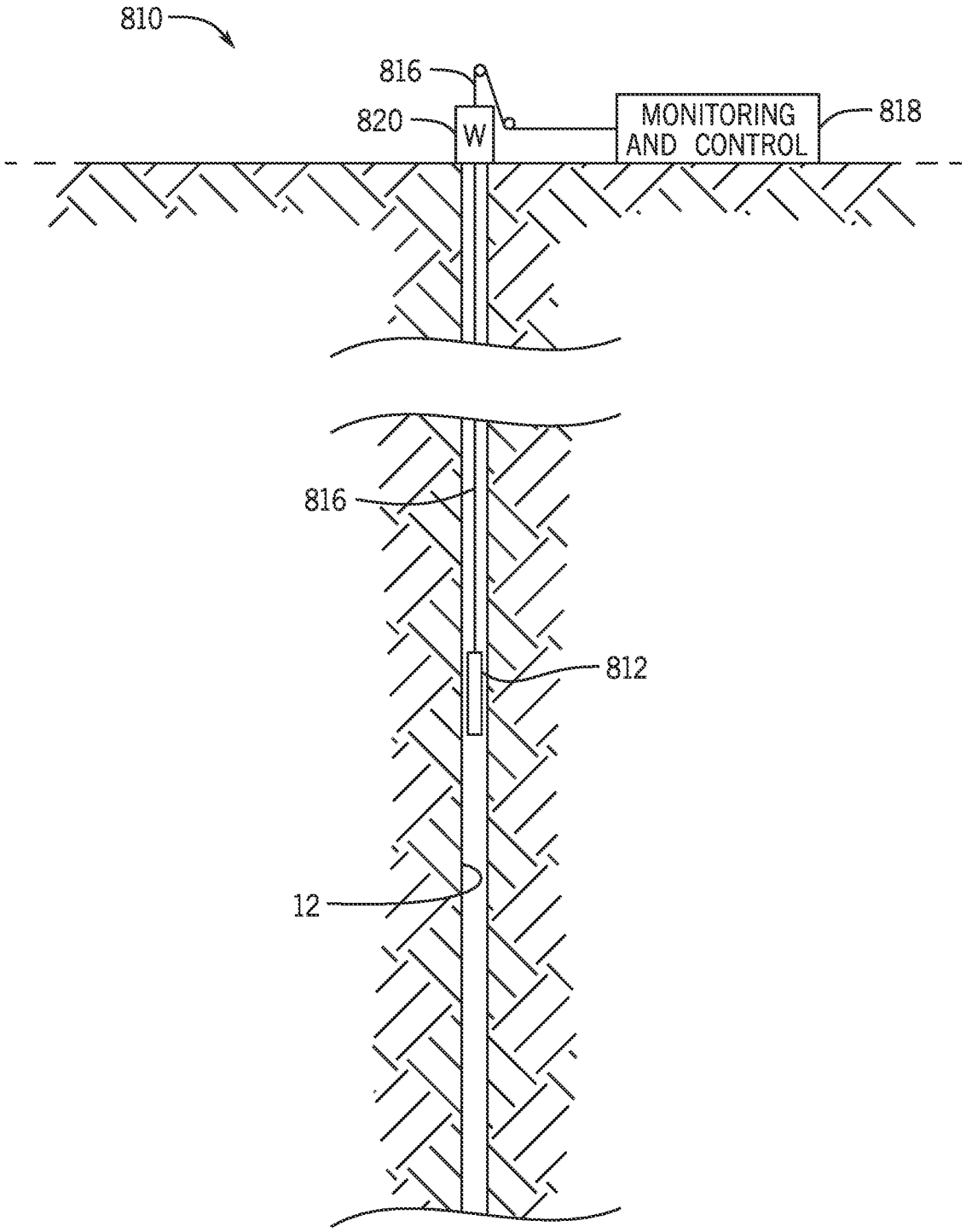
FIG. 45 generally depicts an apparatus including a downhole tool deployed within a well on a cable lowered through a wellhead assembly in accordance with one embodiment.

A well intervention apparatus 810 is depicted in FIG. 45 in accordance with one embodiment. In this depicted embodiment, an intervention tool 812 is suspended in a well 12 on a line 816. The intervention tool 812 could be deployed in the well 12 as a single tool or as multiple tools coupled together in a tool string. In some instances, the intervention tool 812 includes a perforating gun, a plug setting tool, an evaluation tool, or a cleanup tool. Further, the line 816 in some instances is a wireline cable, which may include at least one conductor that enables data transmission between the intervention tool 812 and a monitoring and control system 818. But any suitable line 816 may be used, such as a slickline, a non-conducting braided line, or a coiled tubing line.

The intervention tool 812 may be raised and lowered within the well 12 via the line 816 in any suitable manner. For instance, the line 816 can be reeled from a drum in a service truck, which may be a logging truck having the monitoring and control system 818. While the apparatus 810 is shown in FIG. 45 at an onshore well 12, the apparatus 810 could be used with an offshore well in full accordance with the present techniques.

In some embodiments, the monitoring and control system 818 controls movement of the intervention tool 812 within the well 12 and receives data from the intervention tool 812. In one embodiment, the intervention tool 812 includes a perforating gun and the monitoring and control system 818 sends signals for operating the perforating gun to the intervention tool 812. The monitoring and control system 818 can include one or more computer systems or devices. The system 818 can receive data from the intervention tool 812, and this data can be stored, communicated to an operator, or processed. Although generally depicted in FIG. 45 at a wellsite, it is noted that the system 818 could be positioned elsewhere, and that the system 818 could be a distributed system with elements provided at different places near or remote from the well 12. For example, a local component of the system 818 may be located at the wellsite for controlling operation of the intervention tool 812 and receiving data from the tool 812, but the received data could be processed by a different portion of the system 818 at another location.

The intervention tool 812 can be lowered via the line 816 into the well 12 through a wellhead assembly 820. In some fracturing systems, an intervention tool would be run into a well by connecting a pressure-control string, including a lubricator and a blowout preventer (e.g., a coiled tubing blowout preventer or a wireline blowout preventer, which is also known as a wireline valve), to the top of a fracturing tree. The intervention tool could then be lowered from the lubricator on a line into the well through the pressure-control string blowout preventer, which could be used to seal around the line. But in at least some embodiments of the present technique, the wellhead assembly 820 includes a frac stack having rams for opening and closing a bore and a lubricator to facilitate deployment of the intervention tool 812 into the well 12. The well intervention tool may be run into the well 12 from a lubricator and through the frac stack. Moreover, in some embodiments the wellhead assembly 820 does not include a blowout preventer between the frac stack and the lubricator. That is, rather than having a blowout preventer of a pressure-control string attached above the frac stack, one or more rams of the frac stack may be used to seal around the line 816 during well intervention.

Figure 46:
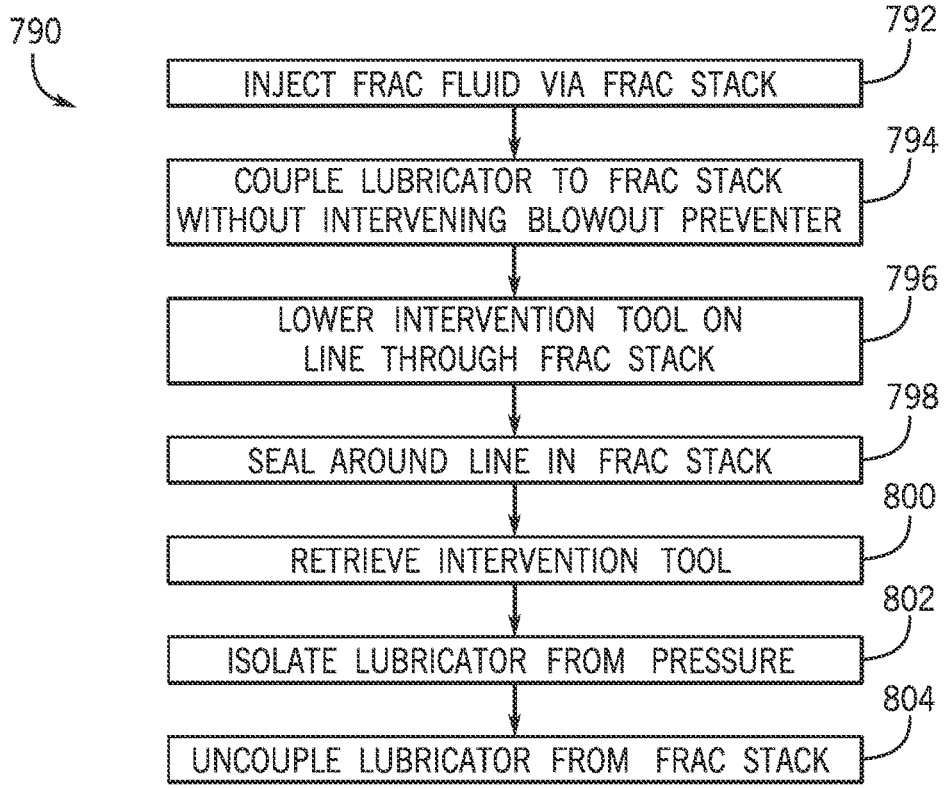
FIG. 46 is a flowchart generally representing a well intervention process in accordance with one embodiment.

In FIG. 46, an example of a well intervention process is generally represented by flowchart 790. In this embodiment, fracturing fluid is injected into a well through a bore of a frac stack coupled to a wellhead (block 792) and a lubricator is coupled to the frac stack without a blowout preventer between the lubricator and the frac stack (block 794). Although generally shown following the injection of frac fluid in FIG. 46, it will be appreciated that the lubricator may be coupled to the frac stack before or after fracturing fluid is injected into the well. An intervention tool (e.g., a tool 812) can be lowered (e.g., via line 816) from the lubricator through the bore of the frac stack and into the well (block 796). In some embodiments, the intervention tool facilitates fracturing operations, such as by perforating a downhole casing or setting an isolation plug.

With the tool lowered into the well on a line, the frac stack can seal around the line (block 798), such as by closing at least one ram to effect a seal about the line and block flow through the bore of the frac stack. In at least some cases, rams of the frac stack are usable as a secondary pressure barrier during tool deployment and the tool may be run into the well and retrieved without closing the rams if pressure is otherwise sufficiently contained. The intervention tool may be retrieved from the well (block 800) and drawn back into the lubricator. The lubricator can then be isolated (block 802) from well pressure (e.g., by closing rams within the frac stack or a swab valve) and uncoupled from the frac stack (block 804). Additional operations could be performed through the frac stack, with the lubricator isolated from well pressure, before disconnecting the lubricator. In some instances, the disconnected lubricator is coupled to an additional frac stack coupled to a wellhead of an additional well to facilitate running of the intervention tool (or a different intervention tool) into the additional well through the additional frac stack. The lubricator can be coupled to the additional frac stack without a blowout preventer between the lubricator and the additional frac stack, and the additional frac stack can include at least one ram that can be closed to effect a seal about a line (e.g., a line 816) suspending the intervention tool in the additional well.

Figure 47:
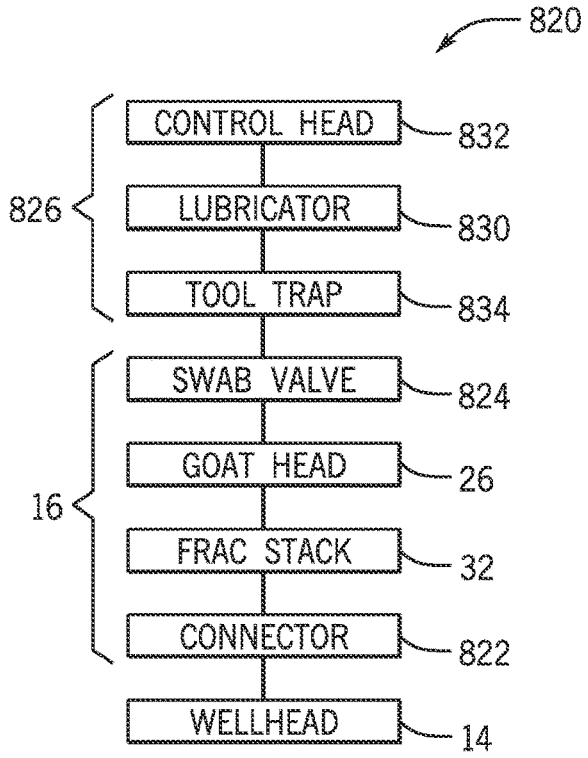
FIG. 47 is a block diagram depicting the wellhead assembly of the apparatus of FIG. 45 in accordance with one embodiment.

Various components of a wellhead assembly 820 having an equipment stack installed on a wellhead 14 are depicted in FIG. 47 in accordance with one embodiment. The depicted equipment includes a fracturing tree 16 mounted over the wellhead 14, with the fracturing tree 16 including a frac stack 32 having rams and a connector 822 for coupling the fracturing tree 16 to the wellhead 14. The connector 822 could have a studded or bolted connection, but in at least some cases the connector 822 includes a quick-connect device (e.g., with a threaded or hydraulically set connection) to facilitate efficient connection of the fracturing tree 16 to the wellhead 14. The depicted fracturing tree 16 also includes a goat head 26 and a swab valve 824. The swab valve is shown in FIG. 47 positioned above the goat head 26, but the swab valve 824 may instead be positioned below the goat head 26.

The equipment of the wellhead assembly 820 in FIG. 46 also includes a lubricator assembly 826 positioned above the fracturing tree 16. The depicted lubricator assembly 826 includes a lubricator 830, a control head 832 (which in some instances may be a grease head), and a tool trap 834. As will be appreciated, the lubricator 830 can include one or more pipes for receiving the tool 812 and facilitating running of the tool 812 into and out of the well 12, the control head 832 seals around the line 816 above the lubricator 830, and the tool trap 834 below the lubricator 830 can catch the tool 812 if it is disconnected from the line 816 while in the lubricator 830. The lubricator assembly 826 may also or instead include other components, such as a stuffing box, a line cutter, and a sheave for running the line 816 into the wellhead assembly 820. The components of the fracturing tree 16 and the lubricator assembly 826 can be connected to each other in any suitable manner. The lubricator assembly 826 can include a connector (e.g., a quick connect) for coupling the lubricator assembly 826 to the fracturing tree 16 directly or via one or more additional components. But in at least some embodiments of the present technique, rather than having a pressure-control string with a lubricator and a blowout preventer connected to a fracturing tree, the lubricator assembly 826 does not include a blowout preventer and the lubricator 830 is coupled to the fracturing tree 16 without an intervening blowout preventer for sealing about the line 816.

Figure 49:
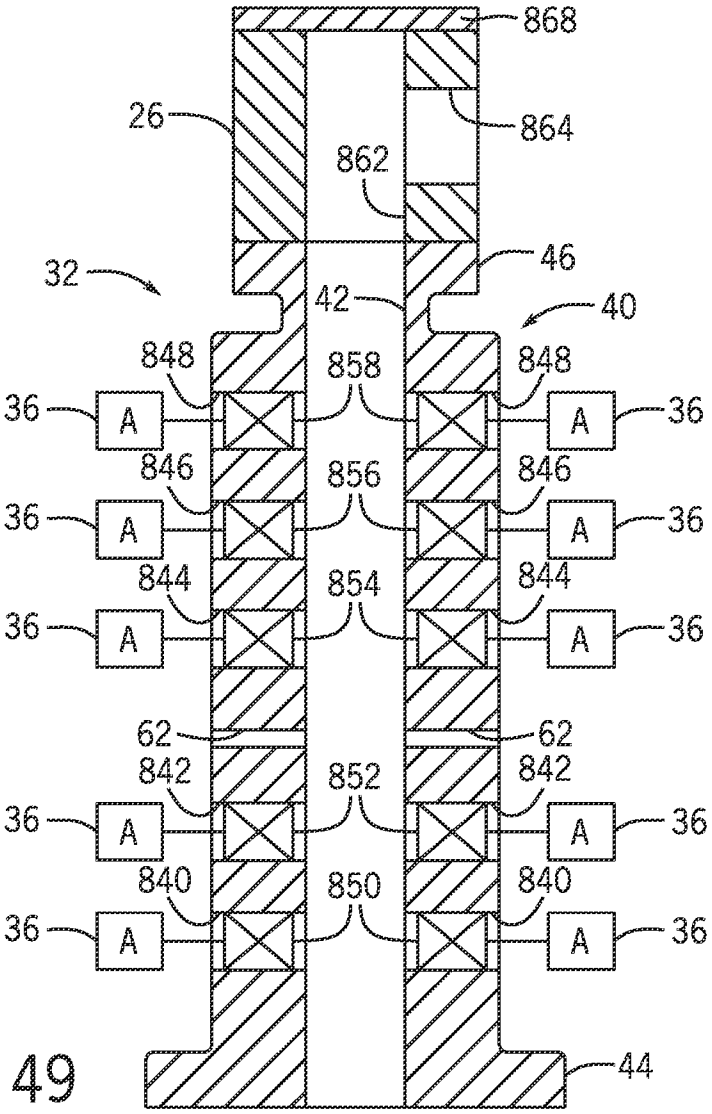
FIGS. 48 and 49 are schematic representations of a frac stack having a bore and rams for controlling flow through the bore in accordance with one embodiment.
Figure 48:
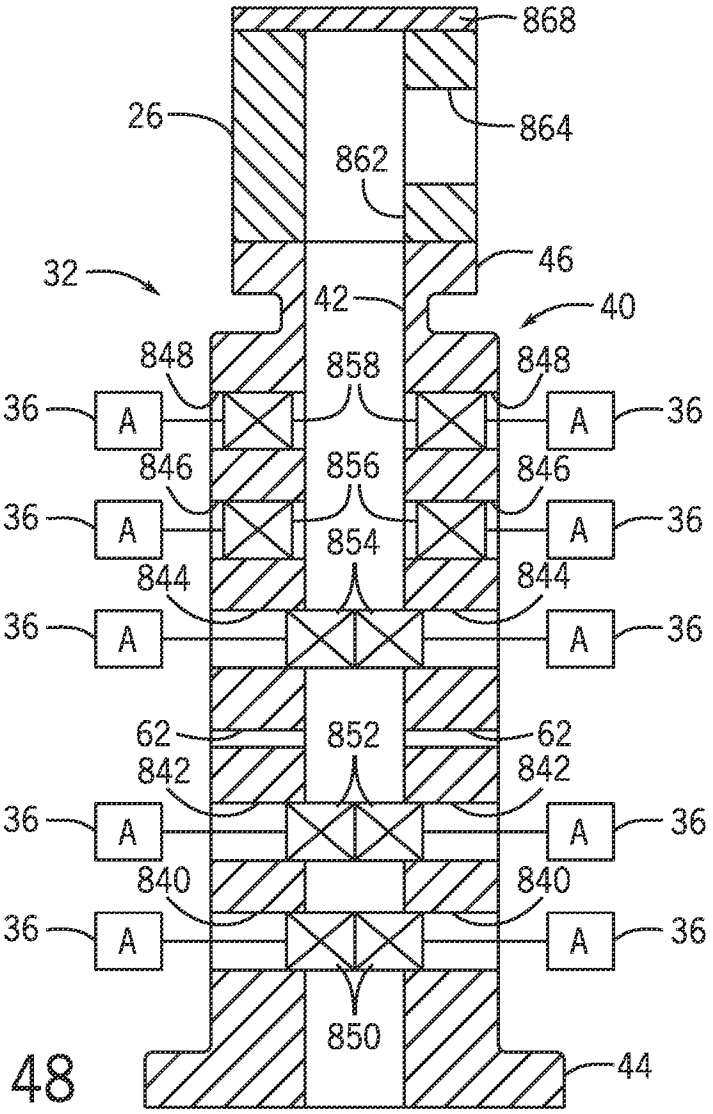

Some embodiments of fracturing trees including rams for sealing about the line 816 are generally depicted in FIGS. 48-55. In FIGS. 48 and 49, for instance, the body 40 of the frac stack 32 includes various rams that can be opened or closed to control flow through the bore 42. More specifically, this depicted ram assembly includes the body 40 having ram cavities 840, 842, 844, 846, and 848 with rams 850, 852, 854, 856, and 858. The body 40 in which the rams are housed can be a unitary body or a multi-piece body. In one embodiment, the body 40 includes multiple housings in which at least one of the rams is installed. Each of the rams 850, 852, 854, 856, and 858 may be any of various types (e.g., blind rams, pipe rams, shear rams, or wireline rams) and shapes (e.g., oval rams, round rams, or rectangular rams) and, collectively, this group of rams may include combinations of such types and shapes. Although the rams are shown in opposing pairs in FIGS. 48 and 49, in other instances one or more pairs of these rams may be replaced by a single ram. In one embodiment, for example, a single ram 850, a single ram 852, and a single ram 854 are used to close the bore 42 in place of the depicted pairs of rams 850, 852, and 854. In such an embodiment, the body 40 may include single ram cavities 840, 842, and 844, rather than pairs of such ram cavities.

Figure 50:
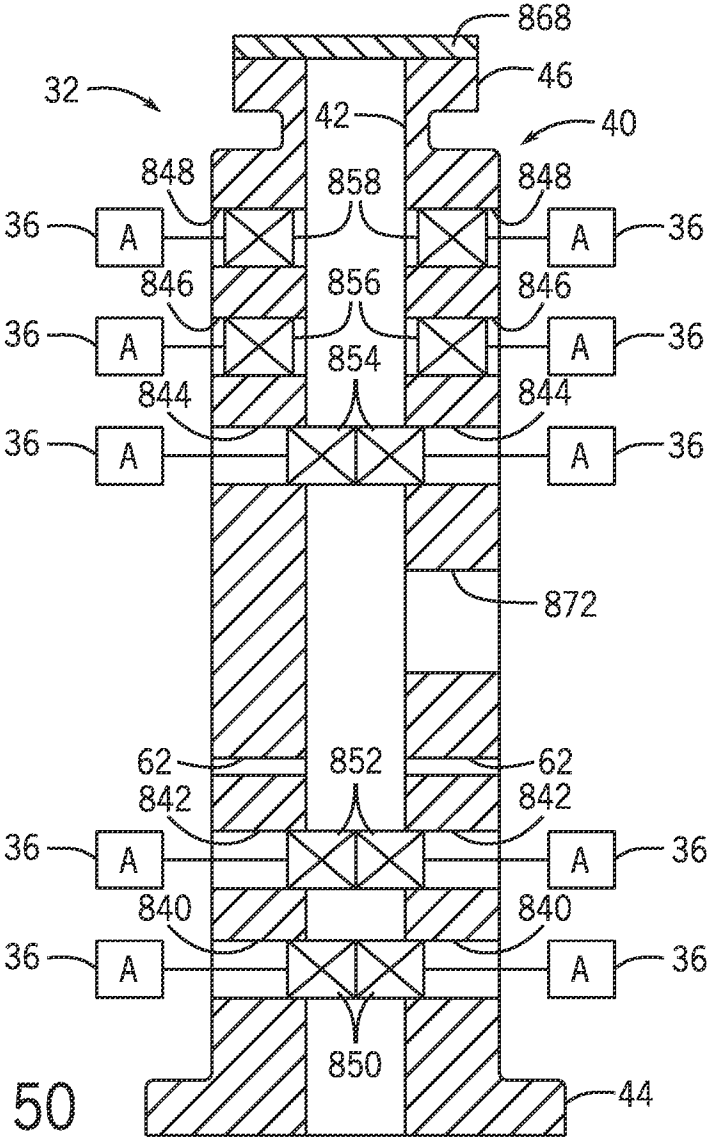
FIG. 50 schematically depicts the frac stack of FIGS. 48 and 49 without a separate goat head in accordance with one embodiment.

As shown in FIGS. 48 and 49, a goat head 26 with a bore 862 is coupled to the body 40. Fracturing fluid can enter the goat head 26 through one or more inlets 864 and pass into the bore 42 of the body 40 via the bore 862 of the goat head 26. A single inlet 864 is depicted in FIGS. 48 and 49, but in other embodiments the goat head 26 can include multiple connections. Further, in some instances multiple goat heads 26 could be used to route fracturing fluid into the bore 42. Although the goat head 26 is shown as a separate component connected above the body 40 in FIGS. 48 and 49, in some embodiments (an example of which is depicted in FIG. 50) the body 40 may also or instead include one or more inlets 872 for receiving fracturing fluid directly into the body 40. In another embodiment, a goat head may be laterally offset from the equipment depicted in FIG. 48, 49, or 50 and connected to route fracturing fluid from the offset goat head into the equipment via one or more of the inlets 864 or 872. A tree cap 868 can be connected above the goat head 26 to seal the upper end of the depicted assembly. Although not shown in FIGS. 48 and 49, it will be appreciated that this equipment may also include a swab valve 824 above the body 40 (e.g., immediately above or below the goat head 26).

As described above, the rams installed in the body 40 can be moved between open and closed positions by actuators 36. In certain embodiments, the rams 850, 852, and 854 are blind rams for sealing an open bore and the rams 856 and 858 are intervention rams for sealing around the line 816 when the intervention tool 812 is lowered into the well 12 through the bore 42. The intervention rams may include pipe rams configured to seal around a tubular line (e.g., coiled tubing) or wireline rams configured to seal around wire or cable (e.g., wireline, slickline, or braided line). The intervention rams in other embodiments may also include shear rams, which may be installed as an additional pair of rams (e.g., between rams 854 and 856 in the body 40) or as some of the rams shown in FIGS. 48 and 49 (e.g., the rams 856 could also or instead be shear rams).

Rams 850, 852, and 854 can be used to control flow of fracturing fluid from the goat head 26 into the well 12 through the bore 42 during a fracturing operation. That is, with intervention rams 856 and 858 retracted to the open position, the rams 850, 852, and 854 can be closed, such as shown in FIG. 48, to block flow through the bore 42 and opened, such as shown in FIG. 49, to allow fracturing fluid to be pumped into the well 12 through the frac stack 32. In some instances, a protective sleeve (e.g., a sleeve like protective sleeve 82 or 102) can be used in the body 40 to protect sealing elements (e.g., elastomer seals) of retracted rams during fracturing. The intervention rams 856 and 858 can remain in the body 40 while fracturing fluid is pumped into the well 12 through the bore 42 or could be installed in the body 40 for tool deployment operations and removed before fracturing through the bore 42.

Figure 51:
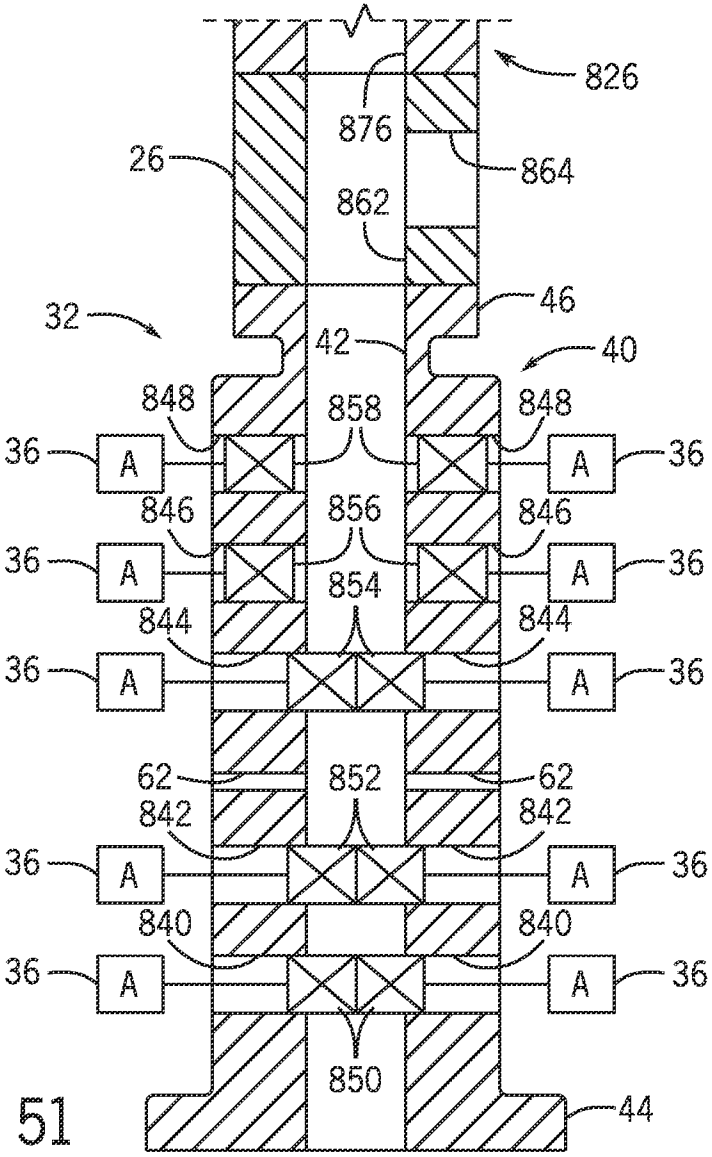
FIG. 51 depicts the frac stack of FIGS. 48 and 49 coupled via a goat head to a lubricator assembly for deploying an intervention tool through the frac stack in accordance with one embodiment.

The tree cap 868 can be removed and the lubricator assembly 826 can be coupled above the frac stack 32. As shown in FIG. 51, for example, the bottom end of the lubricator assembly 826 can be connected to the goat head 26 so that a bore 876 of the lubricator assembly 826 is aligned with the bores 862 and 42 of the goat head 26 and the body 40. In another embodiment generally depicted in FIG. 52, the lubricator assembly 826 is coupled to the body 40 via the goat head 26 and a swab valve 824. Although the swab valve 824 is shown connected above the goat head 26 and below the lubricator assembly 826 in FIG. 52, other arrangements may be used. The swab valve 824 could be positioned below the goat head 26 and above the body 40, for instance. In some instances, the assembly could include multiple swab valves 824. In still another embodiment depicted in FIG. 53, the goat head 26 and swab valve 824 are removed and the lubricator assembly 826 is connected to the upper end of the body 40.

Figure 52:
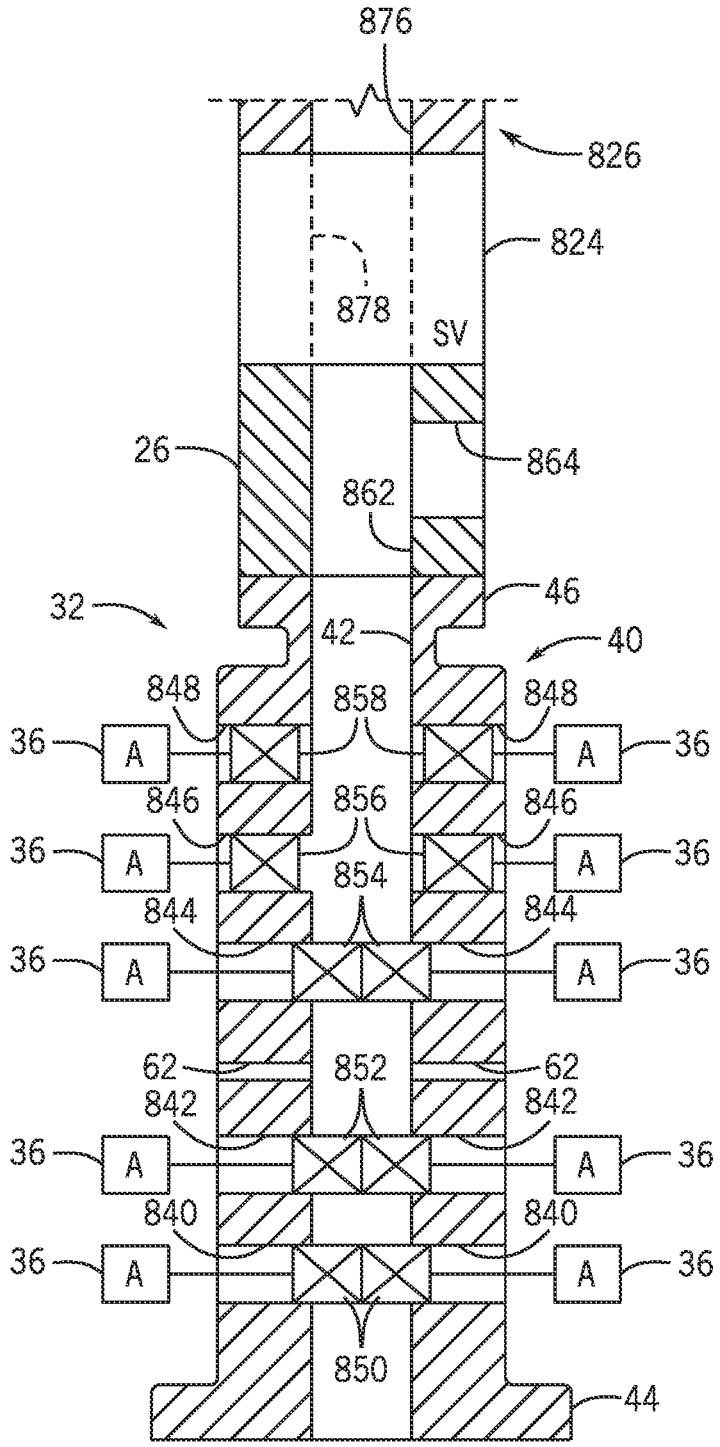
FIG. 52 is similar to FIG. 51 with the addition of a swab valve above the goat head and below the lubricator assembly in accordance with one embodiment.
Figure 53:
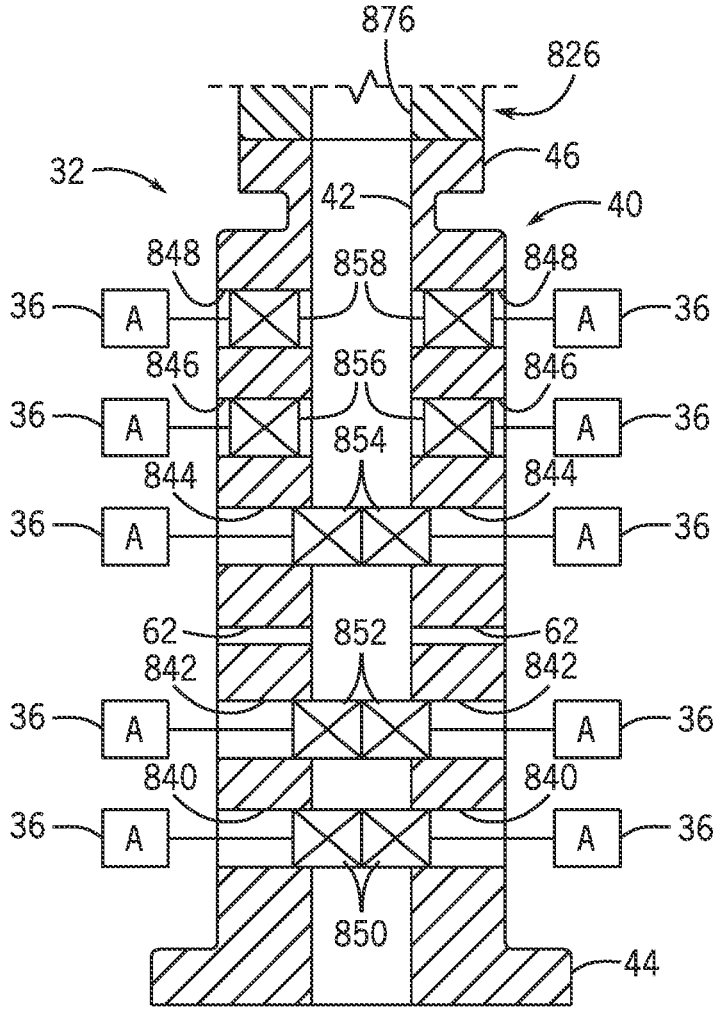
FIG. 53 is similar to FIG. 51 but does not include a goat head in accordance with one embodiment.

Again, in at least some embodiments the lubricator assembly 826 does not include a blowout preventer and is connected to the frac stack 32 without a blowout preventer installed between the lubricator 830 and the fracturing tree 16 (e.g., without a blowout preventer installed between the lubricator 830 and the goat head 26 or swab valve 824 in FIGS. 51-53). In such cases, an intervention tool 812 can be lowered on a line 816 through the bore 42 into the well 12 past intervention rams of the frac stack 32 that can be used to seal about the line 816 and block flow through the bore 42. In at least some embodiments, the rams of the frac stack 32 are positioned below one or more of the goat head 26, the swab valve 824, or a fracturing fluid inlet of the equipment stack. Further, the equipment stack of some embodiments does not include a blowout preventer (e.g., a wireline blowout preventer or coiled tubing blowout preventer) above the frac stack 32 or a blowout preventer (e.g., a drilling blowout preventer) below the frac stack 32. Still further, in some embodiments, the equipment stack does not include any rams above the goat head 26 or above the swab valve 824.

Figure 55:
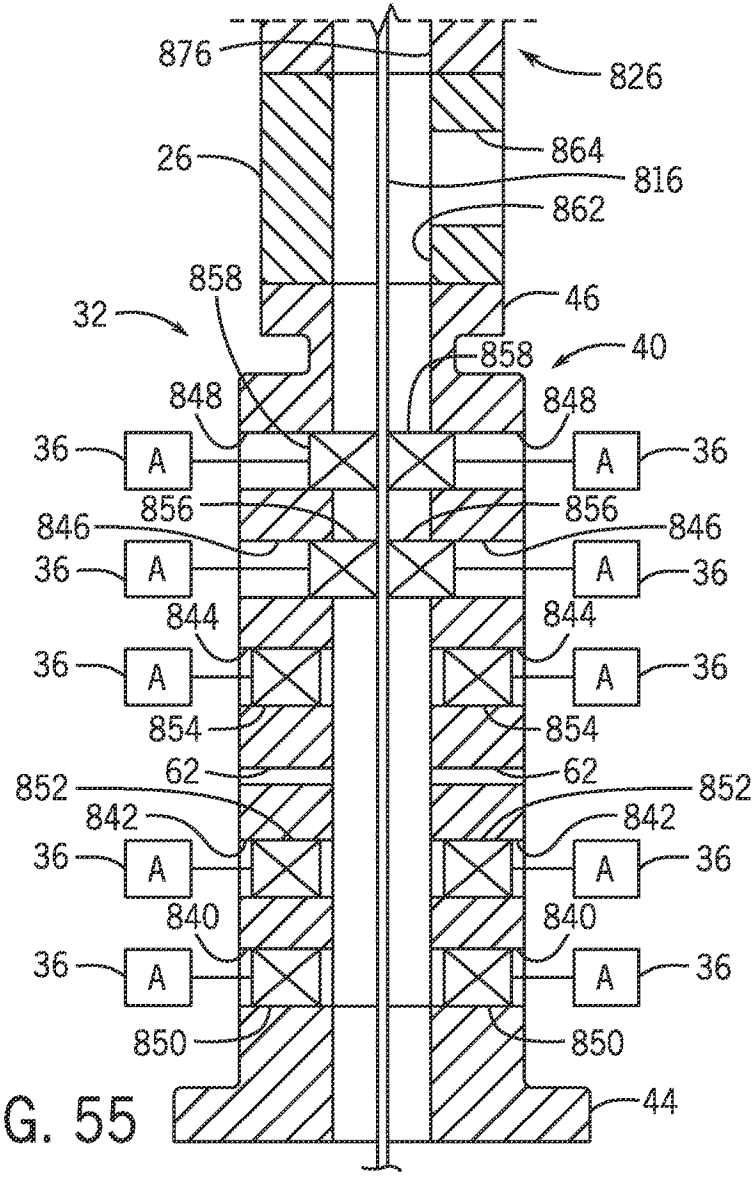
FIG. 55 shows the apparatus of FIG. 54 with intervention rams of the frac stack closed to seal about the line on which the intervention tool is suspended in accordance with one embodiment.
Figure 54:
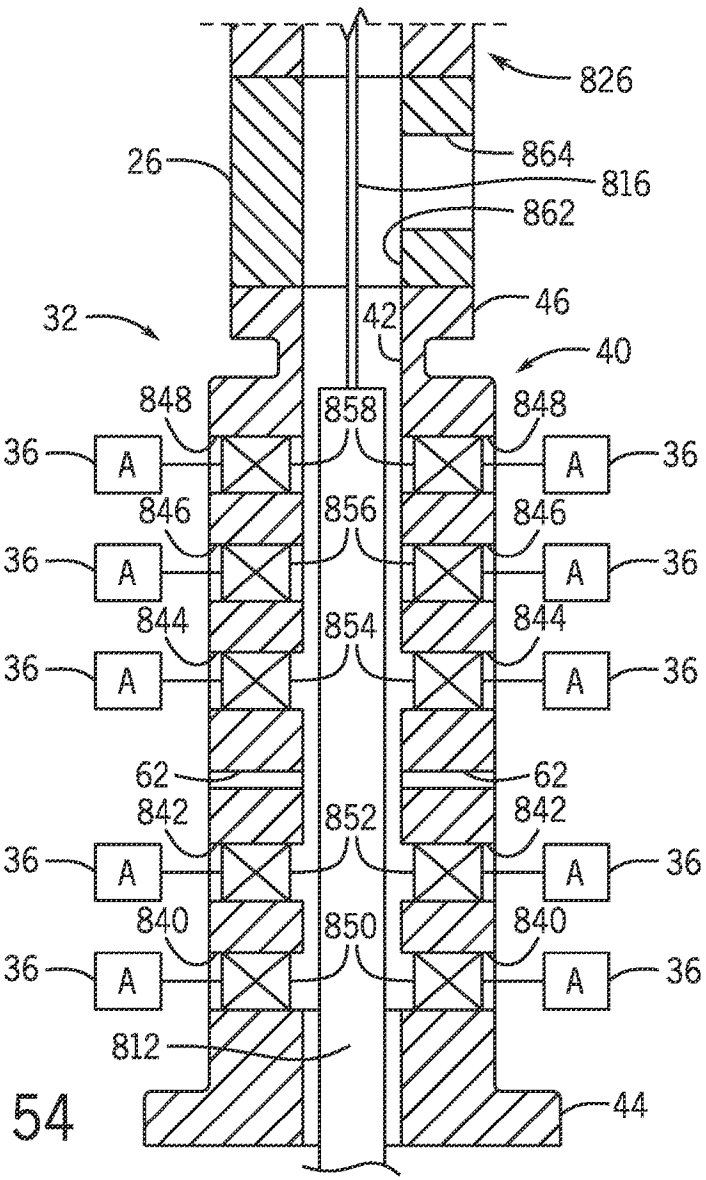
FIG. 54 generally depicts an intervention tool lowered on a line into the frac stack of FIG. 51 from a lubricator in accordance with one embodiment.

An example of the intervention tool 812 being lowered on the line 816 into the well 12 through the frac stack 32 is generally depicted in FIGS. 54 and 55. As noted above, the intervention tool 812 could take various forms depending on the intended function. In some embodiments, the intervention tool 812 can support fracturing operations, such as by perforating downhole casing or setting an isolation plug. With the lubricator assembly 826 mounted above the frac stack 32, the rams 850, 852, 854, 856, and 858 can be opened (as can any swab valve 824 in the equipment stack) to allow the intervention tool 812 to be lowered from the lubricator 830 through goat head 26 and any swab valve 824 (FIG. 52), and then through the bore 42 past the intervention rams (e.g., rams 856 and 858) and blind rams (e.g., rams 850, 852, and 854) into the well 12. With the intervention tool 812 lowered into the well 12, the intervention rams 856 and 858 can be closed to seal around the line 816 and block flow through the bore 42, such as shown in FIG. 55.

In some instances, the intervention rams 856 and 858 serve as a secondary pressure barrier and may remain open during running of the tool 812 into and out of the well 12, such as when performing intervention during low-pressure well conditions. The intervention rams 856 and 858 of some embodiments include wireline rams for sealing around a single-strand or multi-strand wire or cable line 816 (e.g., wireline, slickline, braided line) or pipe rams for sealing around coiled tubing line 816. The intervention tool 812 can be retrieved by raising the tool 812 from the well 12 through the frac stack 32 (past open rams 850, 852, 854, 856, and 858) and back into the lubricator 830.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A well intervention system comprising:
a wellhead; and
an equipment stack mounted over the wellhead, the equipment stack including:
a ram assembly above the wellhead;
a swab valve above the ram assembly; and
a lubricator above the swab valve;
wherein the equipment stack mounted over the wellhead does not include a blowout preventer between the lubricator and the swab valve, and wherein the equipment stack includes a bore and is configured to receive fracturing fluid into the bore at a location above the ram assembly.

2. The well intervention system of claim 1, wherein the equipment stack includes a goat head above the ram assembly and below the swab valve.

3. The well intervention system of claim 1, comprising an intervention tool.

4. The well intervention system of claim 3, wherein the intervention tool is positioned in a well and suspended on a line extending through the lubricator, the swab valve, and the ram assembly.

5. The well intervention system of claim 4, wherein the line is a wireline, a slickline, a braided line, or a coiled tubing line.

6. A well intervention method comprising:
injecting fracturing fluid into a well through a bore of a frac stack coupled to a wellhead, wherein injecting the fracturing fluid into the well through the bore of the frac stack includes pressurizing the bore of the frac stack with the fracturing fluid, the frac stack including rams that can be moved between open and closed positions to control flow of the fracturing fluid through the bore;
lowering a perforating gun through the bore of the frac stack and into the well from a lubricator coupled to the frac stack;
perforating a downhole casing in the well with the perforating gun;
after perforating the downhole casing, retrieving the perforating gun from the well and into the lubricator; and
after retrieving the perforating gun, isolating the lubricator and the perforating gun from well pressure.

7. The well intervention method of claim 6, wherein isolating the lubricator and the perforating gun from well pressure includes closing a swab valve to isolate the lubricator and the perforating gun from well pressure.

8. The well intervention method of claim 6, wherein isolating the lubricator and the perforating gun from well pressure includes closing at least some of the rams of the frac stack to isolate the lubricator and the perforating gun from well pressure.

9. The well intervention method of claim 6, wherein the rams of the frac stack include intervention rams to seal around a line on which the perforating gun is lowered into the well and the method further includes closing the intervention rams to seal around the line.

* * * * *